US009842527B2

(12) United States Patent
Morita

(10) Patent No.: US 9,842,527 B2
(45) Date of Patent: Dec. 12, 2017

(54) DRIVER AND ELECTRONIC DEVICE

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 80 days.

(21) Appl. No.: 14/876,377

(22) Filed: Oct. 6, 2015

(65) Prior Publication Data

US 2016/0111035 A1 Apr. 21, 2016

(30) Foreign Application Priority Data

Oct. 15, 2014 (JP) ..... 2014-210367

(51) Int. Cl.

| | |
|---|---|
| ***G09G 5/10*** | (2006.01) |
| ***G09G 3/20*** | (2006.01) |
| *G09G 3/36* | (2006.01) |
| *G09G 3/3225* | (2016.01) |

(52) U.S. Cl.

CPC ..... *G09G 3/20* (2013.01); *G09G 3/3225* (2013.01); *G09G 3/3648* (2013.01); *G09G 2310/027* (2013.01); *G09G 2310/0248* (2013.01); *G09G 2310/0291* (2013.01)

(58) Field of Classification Search

CPC ..... G09G 2310/0248; G09G 2310/027; G09G 2310/08; G09G 2320/0223; G09G 3/3688; G09G 3/3696

See application file for complete search history.

(56) References Cited

U.S. PATENT DOCUMENTS

| | | | |
|---|---|---|---|
| 5,332,997 | A | 7/1994 | Dingwall et al. |
| 6,101,102 | A | 8/2000 | Brand et al. |
| 6,307,681 | B1 | 10/2001 | Aoki et al. |
| 6,420,988 | B1 | 7/2002 | Azami et al. |
| 6,486,812 | B1 | 11/2002 | Tanaka |
| 6,606,045 | B2 | 8/2003 | Azami et al. |
| 7,436,385 | B2 | 10/2008 | Kim et al. |
| 8,400,439 | B2 | 3/2013 | Morita |

(Continued)

FOREIGN PATENT DOCUMENTS

| | | | |
|---|---|---|---|
| JP | 2000-341125 | A | 12/2000 |
| JP | 2001-156641 | A | 6/2001 |

(Continued)

OTHER PUBLICATIONS

Dec. 7, 2016 Office Action issued in U.S. Appl. No. 14/870,555.

(Continued)

*Primary Examiner* — Insa Sadio
(74) *Attorney, Agent, or Firm* — Oliff PLC

(57) ABSTRACT

In a display device having a driver that drives load lines in an electro-optical panel through capacitor charge redistribution, a data voltage is determined by a capacitance ratio during capacitive driving. However, a panel-side capacitance is a capacitance external to a driver IC, and thus it is difficult to set the capacitance ratio exactly. Accordingly, voltage driving, which outputs a data voltage corresponding to tone data to a data voltage output terminal using a voltage driving circuit, is carried out after capacitive driving that drives the electro-optical panel has been started.

11 Claims, 17 Drawing Sheets

(56) References Cited

U.S. PATENT DOCUMENTS

| | | | | |
|---|---|---|---|---|
| 8,780,103 | B2 | 7/2014 | van Veenendaal et al. | |
| 2005/0168416 | A1* | 8/2005 | Hashimoto | G09G 3/3233 345/76 |
| 2005/0206598 | A1* | 9/2005 | Yamazaki | G09G 3/3648 345/87 |
| 2007/0052566 | A1 | 3/2007 | Sutardja | |
| 2009/0066615 | A1 | 3/2009 | Kawasaki | |
| 2011/0205481 | A1 | 8/2011 | Aruga et al. | |
| 2015/0049073 | A1 | 2/2015 | Morita | |

FOREIGN PATENT DOCUMENTS

| | | | |
|---|---|---|---|
| JP | 2010-102080 | A | 5/2010 |
| JP | 2010-181506 | A | 8/2010 |
| JP | 2015-036757 | A | 2/2015 |
| JP | 2015-038543 | A | 2/2015 |

OTHER PUBLICATIONS

Jul. 18, 2017 Office Action issued in U.S Appl. No. 14/954,025.
Apr. 20, 2017 Office Action issued in U.S Appl. No. 14/876,377.
Mar. 10, 2017 Office Action Issued in U.S Appl. No. 14/925,321.
Aug. 25, 2017 Office Action issued in U.S. Appl. No. 14/925,321.

* cited by examiner $$VQ = 7.5V + 5V \times \frac{2^9 \times GD10 + 2^8 \times GD9 + \cdots + 2^0 \times GD1}{2^9 + 2^8 + \cdots + 2^0}$$

$$= 7.5V + 5V \times \frac{512 \times GD10 + 256 \times GD9 + \cdots + 1 \times GD1}{1023}$$

FE

FIG. 5A RESET
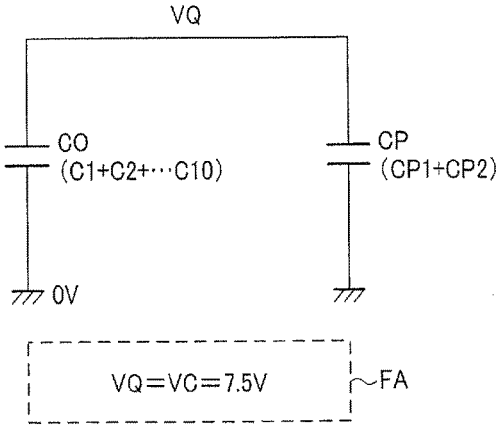
FIG. 5B MAXIMUM DATA VOLTAGE
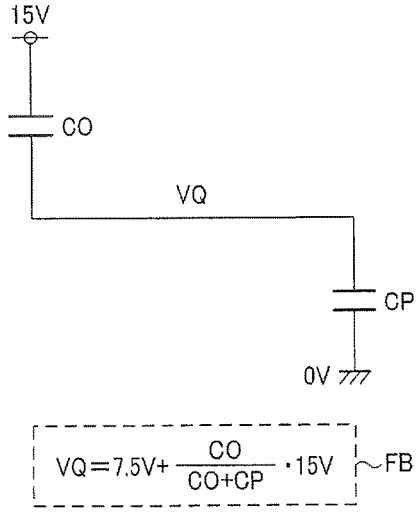
FIG. 5C
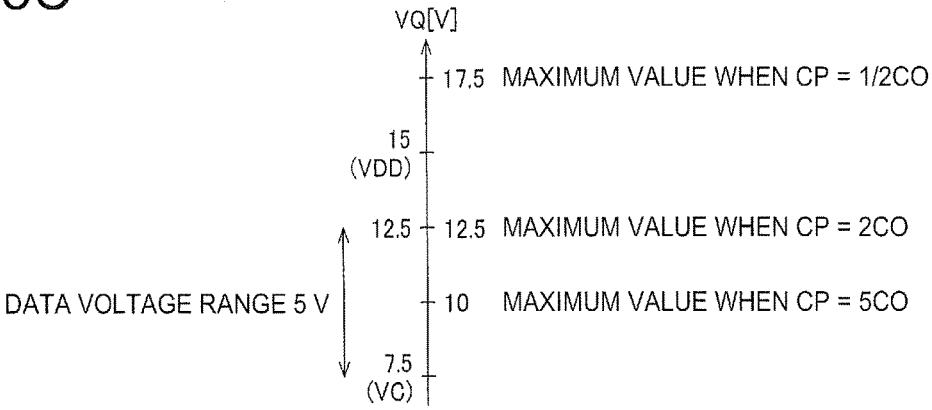

FIG. 7A RESET
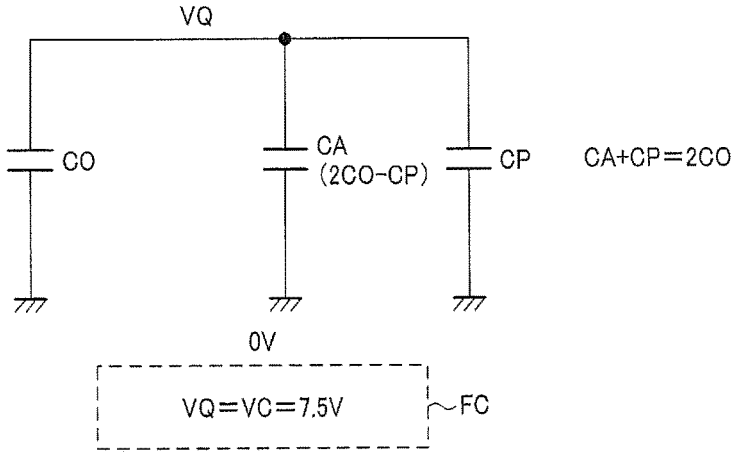
FIG. 7B MAXIMUM DATA VOLTAGE
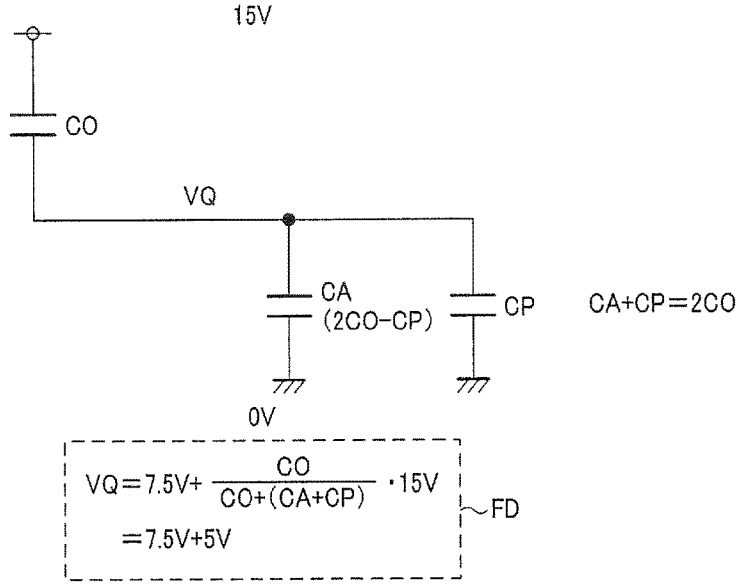
FIG. 7C
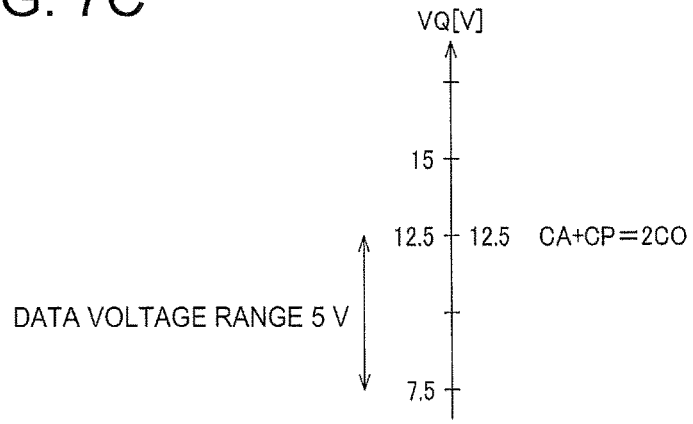

FIG. 11A (S8:NO)
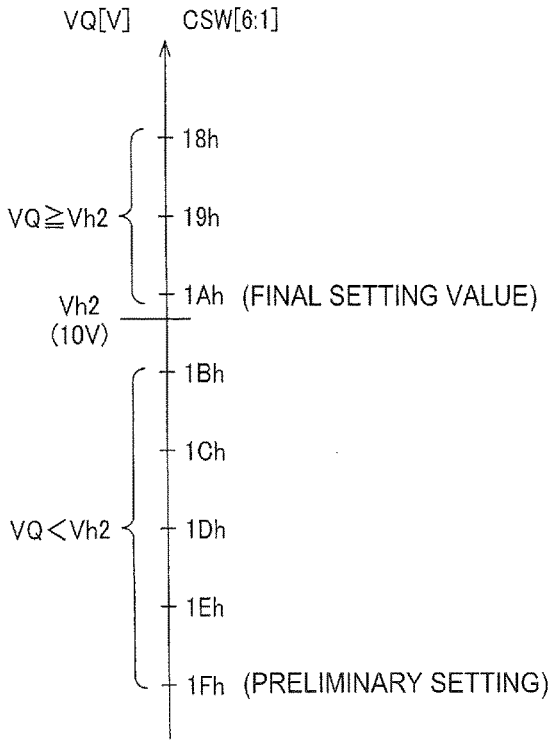
FIG. 11B (S8:YES)
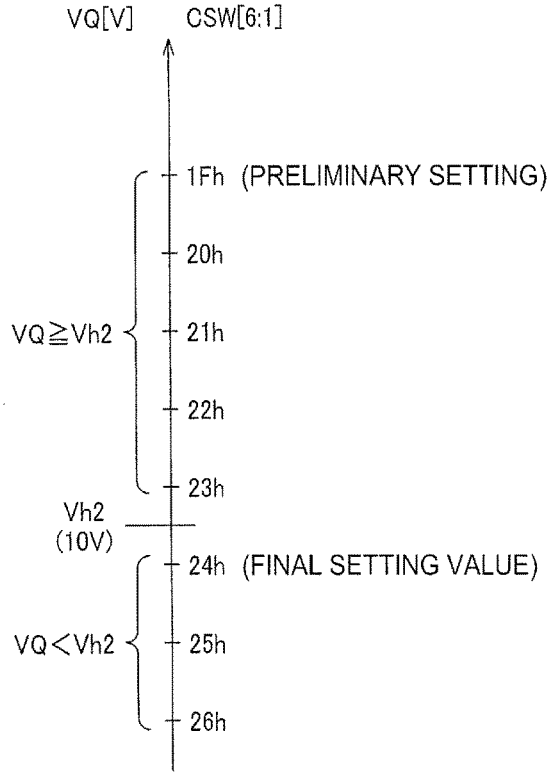

DRIVER AND ELECTRONIC DEVICE

BACKGROUND

1. Technical Field

The present invention relates to drivers, electronic devices, and the like.

2. Related Art

Display devices (liquid-crystal display devices, for example) are used in a variety of electronic devices, including projectors, information processing apparatuses, mobile information terminals, and the like. Increases in the resolutions of such display devices continue to progress, and as a result, the time a driver drives a single pixel is becoming shorter. For example, phase expansion driving is used as a method for driving an electro-optical panel (a liquid-crystal display panel, for example). According to this driving method, for example, eight source lines are driven at one time, and the process is repeated 160 times to drive 1,280 source lines. In the case where a WXGA (1,280×768 pixels) panel is to be driven, the stated 160 instances of driving (that is, the driving of a single horizontal scanning line) is thus repeated 768 times. Assuming a refresh rate of 60 Hz, a simple calculation shows that the driving time for a single pixel is approximately 135 nanoseconds. In actuality, there are periods where pixels are not driven (blanking intervals and the like, for example), and thus the driving time for a single pixel becomes even shorter, at approximately 70 nanoseconds.

Past drivers for driving such electro-optical panels have included D/A conversion circuits for converting tone data (image data) of each pixel into data voltages and amplifier circuits that drive the pixels with the data voltages. This is done in order for the amplifier circuits to carry out impedance conversion and supply charges for capacitance on the electro-optical panel side (parasitic capacitance of interconnects, pixel capacitance, and the like, for example). In other words, past drivers have been configured to supply required charges corresponding to the data voltages.

However, with the increases in resolutions of electro-optical panel as mentioned above, it is becoming difficult for the amplifier circuits to finish writing the data voltages within the required time. For example, in the above WXGA example, it is necessary for the writing for a single pixel to finish within 70 nanoseconds, and thus the write time becomes even shorter if an attempt to further increase the resolution is made. For the amplifier circuits to drive the pixels at high speeds, it is necessary to have a wide output range corresponding to the range of the data voltages, and to be able to supply the charges at a high speed at any voltage within that output range. Achieving both requires, for example, an increase in the bias voltage of the amplifier circuits, resulting in a further increase in power consumption in drivers as increases in resolution progress.

A method that drives an electro-optical panel through capacitor charge redistribution (called "capacitive driving" hereinafter) can be considered as a driving method for solving such problems. For example, JP-A-2000-341125 and JP-A-2001-156641 disclose techniques that use capacitor charge redistribution in D/A conversion. In a D/A conversion circuit, both driving-side capacitance and load-side capacitance are included in an IC, and charge redistribution occurs between those capacitances. For example, assume such a load-side capacitance of the D/A conversion circuit is replaced with the capacitance of the electro-optical panel external to the IC and used as a driver. In this case, charge redistribution occurs between the driver-side capacitance and the electro-optical panel-side capacitance.

However, although charges can be freely supplied with an amplifier circuit, capacitive driving uses charge redistribution, and thus there is a problem that capacitive driving suffers from a drop in data voltage accuracy. For example, in capacitive driving, data voltages are determined by capacitance ratios, but because an electro-optical panel-side capacitance is a capacitance external to the driver IC, it is more difficult to set the capacitance ratio exactly than in the case of a capacitance internal to the IC. Alternatively, there are cases where charge conservation breaks down due to operations within the electro-optical panel and the like (connections between data lines and source lines, for example) and leads to data voltage errors.

SUMMARY

An advantage of some aspects of the invention is to provide a driver, an electronic device, and so on capable of outputting a data voltage at a high level of accuracy in capacitive driving.

One aspect of this invention concerns a driver including a capacitor driving circuit that outputs first to nth capacitor driving voltages (where n is a natural number of 2 or more) corresponding to tone data to first to nth capacitor driving nodes, a capacitor circuit including first to nth capacitors provided between the first to nth capacitor driving nodes and a data voltage output terminal, and a voltage driving circuit that carries out voltage driving, which outputs a data voltage corresponding to the tone data to the data voltage output terminal, after capacitive driving, which drives an electro-optical panel using the capacitor driving circuit and the capacitor circuit, has been started.

According to this aspect of the invention, the electro-optical panel is driven by voltage driving after the driving of the electro-optical panel by capacitive driving has been started. Starting the capacitive driving first makes it possible to settle the data voltage quickly, and by then carrying out the voltage driving thereafter, the data voltage can be outputted at a higher level of accuracy than in capacitive driving. Accordingly, the data voltage can be outputted at a high level of accuracy in the capacitive driving.

According to another aspect of the invention, the voltage driving circuit may include an amplifier circuit that outputs the data voltage and a switching circuit provided between an output of the amplifier circuit and the data voltage output terminal.

Because capacitive driving is faster than driving using an amplifier circuit, an output voltage is pulled toward the output of the amplifier circuit and approaches the data voltage more slowly when voltage driving and capacitive driving are carried out simultaneously. With respect to this point, according to this aspect of the invention, providing the switching circuit makes it possible to disconnect the output of the amplifier circuit and the data voltage output terminal, and output the data voltage through high-speed capacitive driving.

According to another aspect of the invention, the switching circuit may turn off in a first period spanning from the start of the capacitive driving to the start of the voltage driving and turn on in a second period in which the voltage driving is carried out.

Accordingly, after the switching circuit turns off and the voltage is quickly brought toward the data voltage through the capacitive driving in the first period, the switching circuit turns on and the highly-accurate output of the amplifier circuit can be outputted to the data voltage output terminal in the second period.

According to another aspect of the invention, the driver may further include a reference voltage generation circuit that generates a plurality of reference voltages, and a D/A conversion circuit that selects a reference voltage corresponding to the tone data from the plurality of reference voltages and outputs the selected reference voltage to the amplifier circuit; the amplifier circuit may amplify the selected reference voltage and output the amplified reference voltage as the data voltage after the capacitive driving has been started.

Accordingly, a plurality of reference voltages are generated by the reference voltage generation circuit provided internally in the driver, and thus a more accurate data voltage can be outputted than in the capacitive driving. In other words, a more accurate data voltage can be outputted by voltage driving, in which the data voltage is generated internally in the driver, than in capacitive driving, in which the data voltage is determined by a capacitance ratio relative to an electro-optical panel-side capacitance that is external to the driver.

According to another aspect of the invention, the electro-optical panel may include a switching element provided between a data line and a source line, and the switching circuit of the voltage driving circuit may turn on after the capacitive driving has started and before the switching element of the electro-optical panel turns on.

The voltage of the data line varies due to the data line and the source line of the electro-optical panel being connected by the switching element, and thus by starting driving using the amplifier circuit before that time, the voltage of the source line can be settled at the data voltage as quickly as possible.

According to another aspect of the invention, the switching circuit of the voltage driving circuit may turn off after the switching element of the electro-optical panel turns from on to off.

The voltage of the source line of the electro-optical panel is fixed when the switching element of the electro-optical panel turns off. Accordingly, by turning the switching circuit of the voltage driving circuit off after the switching element of the electro-optical panel has turned from on to off, the voltage of the source line can be established in a state in which the source line has been driven by a highly-accurate data voltage.

According to another aspect of the invention, the driver according may further include a precharge amplifier circuit that outputs a prescribed precharge voltage to the source line of the electro-optical panel in a precharge period that comes before the capacitive driving is carried out.

By carrying out precharge driving before the electro-optical panel is driven by capacitive driving, the quality of displayed images can be improved. In the case where a precharge has been carried out, the data line is at the data voltage and the source line voltage is at the precharge voltage when the data line and the source line are connected. Error arises in the data voltage when a data line and a source line at different voltages are connected in this manner. With respect to this point, according to this aspect of the invention, the source line is driven by the voltage driving circuit with the data voltage, and thus a highly-accurate data voltage can be written.

According to another aspect of the invention, the driver may further include a variable capacitance circuit provided between the data voltage output terminal and a reference voltage node; and a capacitance of the variable capacitance circuit may be set so that a capacitance obtained by adding a capacitance of the variable capacitance circuit and an electro-optical panel-side capacitance is in a prescribed capacitance ratio relationship with a capacitance of the capacitor circuit.

Accordingly, even if the electro-optical panel-side capacitance is different, the prescribed capacitance ratio relationship can be realized by adjusting the capacitance of the variable capacitance circuit in accordance therewith, and a desired data voltage range that corresponds to that capacitance ratio relationship can be realized. In other words, capacitive driving that is generally applicable in a variety of connection environments (the type of the electro-optical panel connected to the driver, the design of a printed circuit board on which the driver is mounted, and so on, for example) can be realized.

Another aspect of the invention concerns an electronic device including any of the drivers described above.

BRIEF DESCRIPTION OF THE DRAWINGS

The invention will be described with reference to the accompanying drawings, wherein like numbers reference like elements.

FIGS. 5A to 5C are diagrams illustrating data voltages in the first configuration example.

FIGS. 7A to 7C are diagrams illustrating data voltages in the third configuration example.

FIGS. 11A and 11B are diagrams illustrating a process for setting a capacitance of a variable capacitance circuit.

DESCRIPTION OF EXEMPLARY EMBODIMENTS

Hereinafter, preferred embodiments of the invention will be described in detail. Note that the embodiments described hereinafter are not intended to limit the content of the invention as described in the appended claims in any way, and not all of the configurations described in these embodiments are required as the means to solve the problems as described above.

1. First Example of Configuration of Driver

Figure 1:
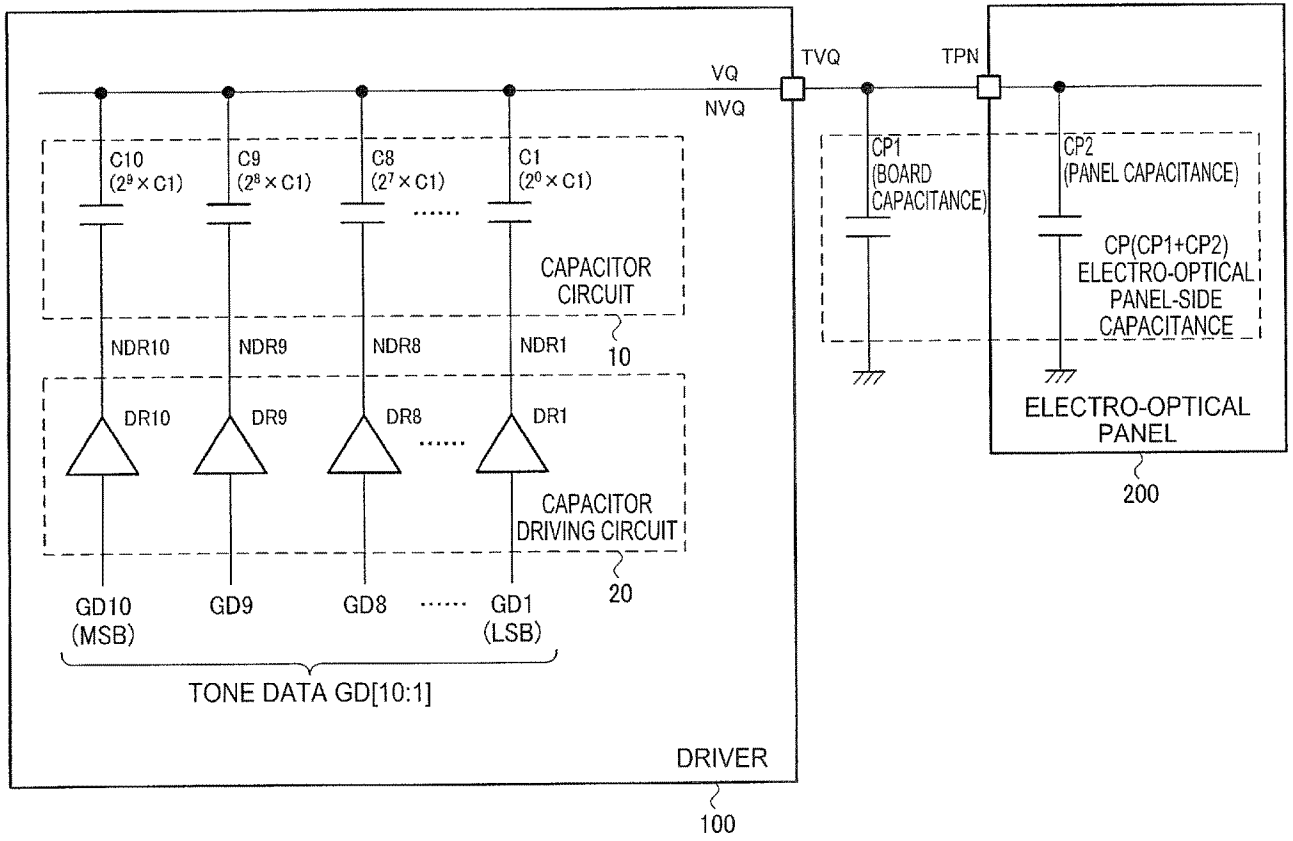
FIG. 1 illustrates a first example of the configuration of a driver.

FIG. 1 illustrates a first example of the configuration of a driver according to this embodiment. This driver 100 includes a capacitor circuit 10, a capacitor driving circuit 20, and a data voltage output terminal TVQ. Note that in the following, the same sign as a sign for a capacitor is used as a sign indicating a capacitance value of that capacitor.

The driver 100 is constituted by an integrated circuit (IC) device, for example. The integrated circuit device corresponds to an IC chip in which a circuit is formed on a silicon substrate, or a device in which an IC chip is held in a package, for example. Terminals of the driver 100 (the data voltage output terminal TVQ and so on) correspond to pads or package terminals of the IC chip.

The capacitor circuit 10 includes first to nth capacitors C1 to Cn (where n is a natural number of 2 or more). The capacitor driving circuit 20 includes first to nth driving units DR1 to DRn. Although the following describes a case where n=10 as an example, n may be any natural number greater than or equal to 2. For example, n may be set to the same number as the bit number of tone data.

One end of an ith capacitor in the capacitors C1 to C10 (where i is a natural number no greater than n, which is 10) is connected to a capacitor driving node NDRi, and another end of the ith capacitor is connected to a data voltage output node NVQ. The data voltage output node NVQ is a node connected to the data voltage output terminal TVQ. The capacitors C1 to C10 have capacitance values weighted by a power of 2. Specifically, the capacitance value of the ith capacitor Ci is $2^{(i-1)}\times C1$.

An ith bit GDi of tone data GD [10:1] is inputted into an input node of an ith driving unit DRi of the first to tenth driving units DR1 to DR10. An output node of the ith driving unit DRi corresponds to the ith capacitor driving node NDRi. The tone data GD [10:1] is constituted of first to tenth bits GD1 to GD10 (first to nth bits), where the bit GD1 corresponds to the LSB and the bit GD10 corresponds to the MSB.

The ith driving unit DRi outputs a first voltage level in the case where the bit GDi is at a first logic level and outputs a second voltage level in the case where the bit GDi is at a second logic level. For example, the first logic level is 0 (low-level), the second logic level is 1 (high-level), the first voltage level is a voltage at a low-potential side power source VSS (0 V, for example), and the second voltage level is a voltage at a high-potential side power source VDD (15 V, for example). For example, the ith driving unit DRi is constituted of a level shifter that level-shifts the inputted logic level (a 3 V logic power source, for example) to the output voltage level (15 V, for example) of the driving unit DRi, a buffer circuit that buffers the output of that level shifter, and so on.

As described above, the capacitance values of the capacitors C1 to C10 are weighted by a power of 2 that is based on the order of the bits GD1 to GD10 in the tone data GD [10:1]. The driving units DR1 to DR10 output 0 V or 15 V in accordance with the bits GD1 to GD10, and the capacitors C1 to C10 are driven by those voltages. As a result of this driving, charge redistribution occurs between the capacitors C1 to C10 and an electro-optical panel-side capacitance CP, and a data voltage is output to the data voltage output terminal TVQ as a result.

The electro-optical panel-side capacitance CP is the sum of capacitances as viewed from the data voltage output terminal TVQ. For example, the electro-optical panel-side capacitance CP is a result of adding a board capacitance CP1 that is parasitic capacitance of a printed circuit board with a panel capacitance CP2 that is parasitic capacitance, pixel capacitances, and the like within an electro-optical panel 200.

Specifically, the driver 100 is mounted on a rigid board as an integrated circuit device, a flexible board is connected to that rigid board, and the electro-optical panel 200 is connected to that flexible board. Interconnects are provided on the rigid board and the flexible board for connecting the data voltage output terminal TVQ of the driver 100 to a data voltage input terminal TPN of the electro-optical panel 200. Parasitic capacitance of these interconnects corresponds to the board capacitance CP1. Meanwhile, as will be described later with reference to FIG. 15, data lines connected to the data voltage input terminal TPN, source lines, switching elements that connect the data lines to the source lines, pixel circuits connected to the source lines, and so on are provided in the electro-optical panel 200. The switching elements are constituted by TFTs (Thin Film Transistors), for example, and there is parasitic capacitance between the sources and gates thereof. Many switching elements are connected to the data lines, and thus the parasitic capacitance of many switching elements is present on the data lines. Parasitic capacitance is also present between data lines, source lines, or the like and a panel substrate. In the liquid-crystal display panel, there is capacitance in the liquid-crystal pixels. The panel capacitance CP2 is the sum of those capacitances.

The electro-optical panel-side capacitance CP is 50 pF to 120 pF, for example. As will be described later, to ensure a ratio of 1:2 between a capacitance CO of the capacitor circuit 10 (the sum of the capacitances of the capacitors C1 to C10) and the electro-optical panel-side capacitance CP, the capacitance CO of the capacitor circuit 10 is 25 pF to 60 pF. Although large as a capacitance internal to an integrated circuit, the capacitance CO of the capacitor circuit 10 can be achieved by a cross-sectional structure that, for example, vertically stacks two to three levels of MIM (Metal Insulation Metal) capacitors.

2. Data Voltages

Next, data voltages outputted by the driver 100 with respect to the tone data GD [10:1] will be described. Here, it is assumed that the capacitance CO of the capacitor circuit 10 (=C1+C2+ . . . C10) is set to CP/2.

Figure 2A:
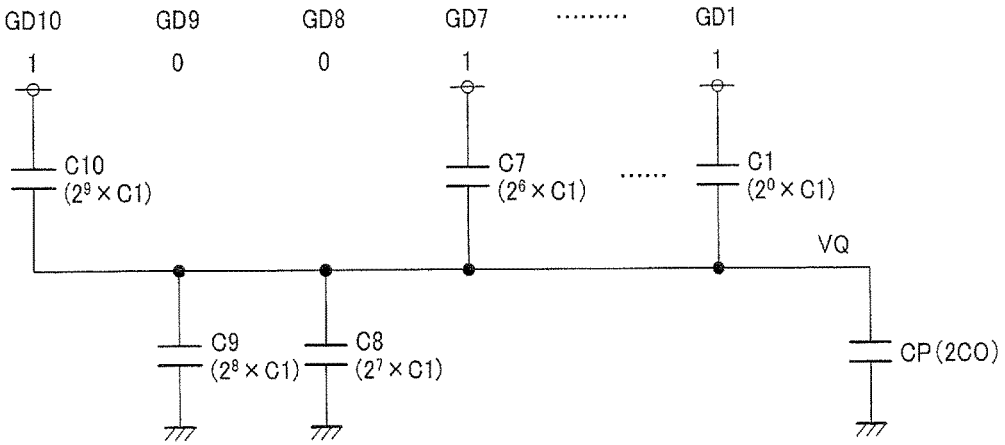
FIGS. 2A and 2B are diagrams illustrating data voltages corresponding to tone data.

As illustrated in FIG. 2A, the driving unit DRi outputs 0 V in the case where the ith bit GDi is "0", and the driving unit DRi outputs 15 V in the case where the ith bit GDi is "1". FIG. 2A illustrates an example of a case where GD[10:1]="1001111111b" (the b at the end indicates that the number within the " is binary).

First, a reset is carried out prior to driving. In other words, GD[10:1] is set to "0000000000b", 0 V is output to the driving units DR1 to DR10, and a voltage VQ is set to VC=7.5 V. VC=7.5 V corresponds to a reset voltage.

Figure 2B:
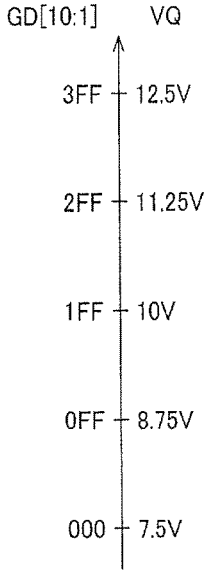

In this reset, a charge accumulated at the data voltage output node NVQ is also conserved in the driving carried out thereafter, and thus based on the principle of charge conservation, Formula FE in FIG. 2A is found. In Formula FE, the sign GDi expresses the value of the bit GDi ("0" or "1"). Looking at the second term on the right side of Formula FE, it can be seen that the tone data GD [10:1] is converted into 1,024-tone data voltages (5 V×0/1,023, 5 V×1/1,023, 5 V×2/1,023, . . . , 5 V×1,023/1,023). FIG. 2B illustrates a data voltage (the output voltage VQ) when the most significant three bits of the tone data GD [10:1] have been changed as an example.

Although positive-polarity driving has been described as an example thus far, it should be noted that negative-polarity driving may be carried out in this embodiment. Inversion driving that alternates positive-polarity driving and negative-polarity driving may be carried out as well. In negative-polarity driving, the outputs of the driving units DR1 to DR10 in the capacitor driving circuit 20 are all set to 15 V in the reset, and the output voltage VQ is set to VC=7.5 V. The logic level of each bit in the tone data GD [10:1] is inverted ("0" to "1" and "1" to "0"), inputted into the capacitor driving circuit 20, and capacitive driving is carried out. In this case, a VQ of 7.5 V is outputted with respect to tone data GD [10:1] of "000h", a VQ of 2.5 V is outputted with respect to tone data GD [10:1] of "3FFh", and the data voltage range becomes 7.5 V to 2.5 V.

3. Second Example of Configuration of Driver

In the driving of the electro-optical panel 200, precharge driving that writes a precharge voltage to the source lines before an image is displayed is carried out. This is done in order to increase the display quality by starting display driving after first setting all of the source lines to the same voltage. Capacitive driving has a problem in that the conservation of the charge at the data voltage output node NVQ breaks down and error arises in the data voltage due to this precharge driving. This point will be described hereinafter.

First, the configuration and a method of driving the electro-optical panel 200 will be described briefly using FIGS. 15 and 4.

The following descriptions will use a data line DL1 and a source line SL1 as examples. As illustrated in FIG. 15, the data line DL1 of the electro-optical panel 200 is driven by a data line driving circuit DD1 of the driver 100. The data line driving circuit DD1 corresponds to the capacitor circuit 10 and the capacitor driving circuit 20 illustrated in FIG. 1. The data line DL1 is connected to the source line SL1 by a switching element SWEP1.

Figure 4:
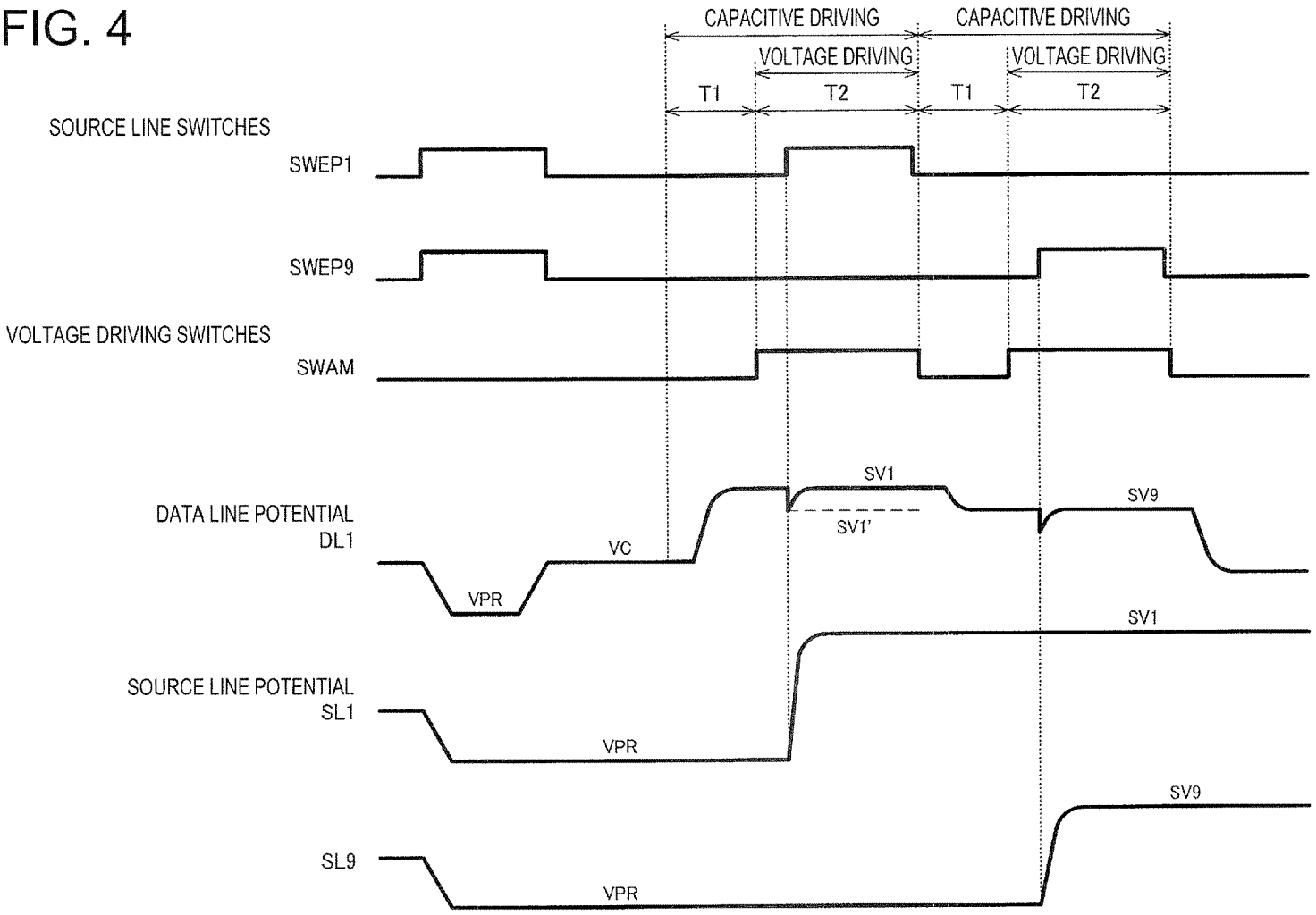
FIG. 4 is an operational timing chart of the second configuration example.

As illustrated in FIG. 4, first, the switching element SWEP1 turns on, the data line driving circuit DD1 outputs a precharge voltage VPR, and the data line DL1 and the source line SL1 are set to the precharge voltage VPR. Next, the switching element SWEP1 turns off, the data line driving circuit DD1 outputs a reset voltage VC, and the data line DL1 is set to the reset voltage VC. Next, the data line driving circuit DD1 starts capacitive driving, and the data line DL1 is driven by a data voltage SV1. Next, the switching element SWEP1 turns on, the data line DL1 and the source line SL1 are connected, and the data voltage SV1 is written to the source line SL1.

As described in the first configuration example, after the data line DL1 (the data voltage output node NVQ) is reset by the reset voltage VC, the charge in the data line DL1 is conserved, and a data voltage using the reset voltage VC as a reference is outputted. However, when the switching element SWEP1 turns on and the data line DL1 and the source line SL1 are connected, the source line SL1 is at the precharge voltage VPR (which is different from the source voltage SV1 of the data line DL1), and thus the conservation of the charge at the data line DL1 breaks down. Accordingly, the voltage at the data line DL1 shifts from SV1 to SV1', resulting in an error relative to the desired source voltage SV1.

Figure 3:
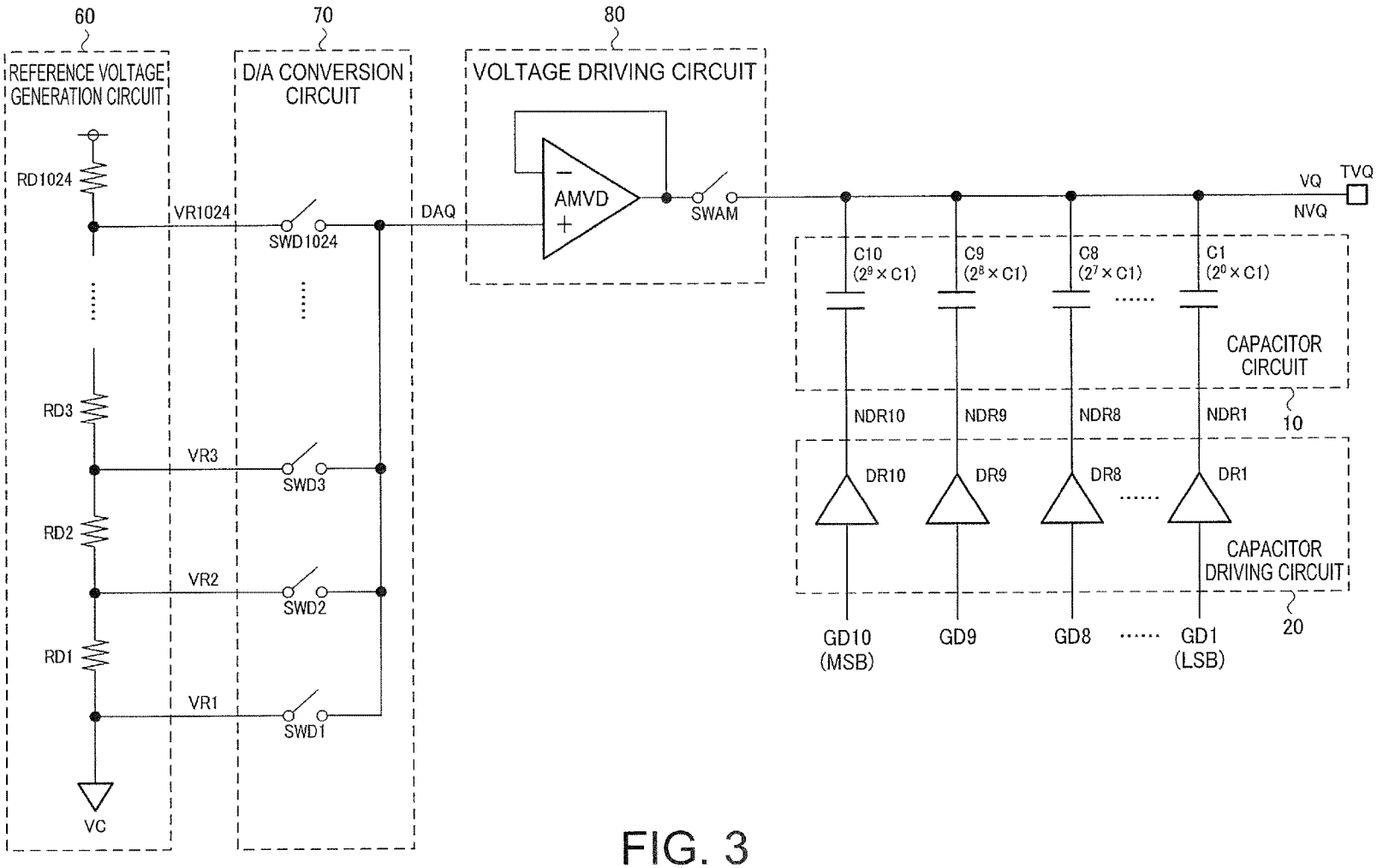
FIG. 3 illustrates a second example of the configuration of a driver.

FIG. 3 illustrates a second example of the configuration of a driver according to this embodiment, capable of solving the stated problem. This driver 100 includes the capacitor circuit 10, the capacitor driving circuit 20, a reference voltage generation circuit 60, a D/A conversion circuit 70 (a voltage selection circuit), a voltage driving circuit 80, and the data voltage output terminal TVQ. Note that constituent elements that are the same as constituent elements already described are assigned the same reference numerals, and descriptions of those constituent elements are omitted as appropriate.

The reference voltage generation circuit 60 is a circuit that generates reference voltages (tone voltages) corresponding to each value in the tone data. For example, reference voltages VR1 to VR1024 for the 1,024 tones are generated corresponding to the 10-bit tone data GD [10:1].

Specifically, the reference voltage generation circuit 60 includes first to 1,024th resistance elements RD1 to RF1024 connected in series between the high-potential side power source and a node at the reset voltage VC (a common voltage). The first to 1,024th reference voltages VR1 to VR1024, which are obtained through voltage division, are outputted from taps of the resistance elements RD1 to RF1024.

The D/A conversion circuit 70 is a circuit that selects a reference voltage corresponding to the tone data GD [10:1], from among the plurality of reference voltages from the reference voltage generation circuit 60. The selected reference voltage is outputted as an output voltage DAQ.

Figure 8:
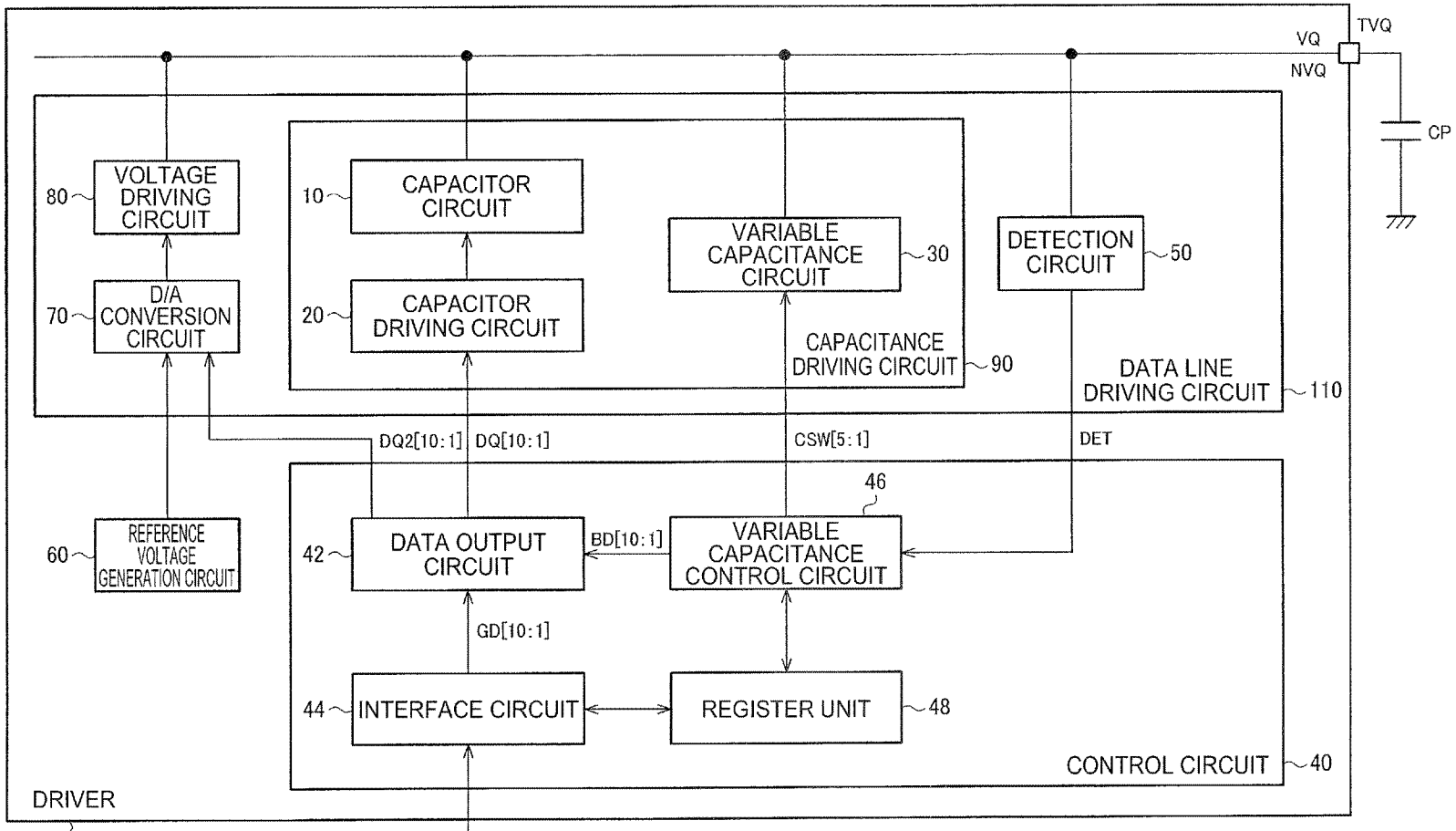
FIG. 8 illustrates an example of the detailed configuration of a driver.

Specifically, the D/A conversion circuit 70 includes first to 1,024th switching elements SWD1 to SWD1024 to one end of which the reference voltages VR1 to VR1024 are respectively supplied. Other ends of the switching elements SWD1 to SWD1024 are connected in common. One of the switching elements SWD1 to SWD1024 turns on in correspondence with the tone data GD [10:1], and the reference voltage supplied to that switching element is outputted as the output voltage DAQ. An on/off control signal for the switching elements SWD1 to SWD1024 is supplied from a control circuit 40, for example, as illustrated in FIG. 8. Alternatively, the D/A conversion circuit 70 may have a decoder that decodes the tone data GD [10:1], and the tone data GD [10:1] may be inputted to the decoder from the control circuit 40.

Note that the configuration of the D/A conversion circuit 70 is not limited to that illustrated in FIG. 3. For example, a tournament system may be used, where the switching elements are provided in multiple stages and the selection is carried out in tournament format. In the tournament system, for example, selectors that select a single reference voltage from among 16 reference voltages are stacked in two stages (16×16=256), and a selector that selects a single reference voltage from among the four reference voltages selected by the previous stages (256×4=1,024) is provided in the third stage.

The voltage driving circuit 80 amplifies the output voltage DAQ from the D/A conversion circuit 70 and outputs the amplified voltage to the data voltage output terminal TVQ (this is called "voltage driving" hereinafter). The voltage driving circuit 80 includes an amplifier circuit AMVD and a switching circuit SWAM.

The amplifier circuit AMVD has an op-amp circuit, and the op-amp circuit is configured as, for example, a voltage follower. The output voltage DAQ from the D/A conversion circuit 70 is inputted into an input of the voltage follower.

The switching circuit SWAM is a circuit that connects/disconnects the output of the amplifier circuit AMVD to/from the data voltage output node NVQ. The switching circuit SWAM may, for example, be constituted of a single switching element, or may be configured as a circuit that includes a plurality of switching elements. An on/off control signal for the switching circuit SWAM is supplied from the control circuit 40 (a timing controller, which is not shown), for example, as illustrated in FIG. 8.

4. Operations of Second Configuration Example

FIG. 4 is an operational timing chart of the aforementioned second configuration example. The following descriptions will take the data line DL1, the switching element SWEP1, and the source lines SL1 and SL9 illustrated in FIG. 15 as examples.

First, precharge driving and a reset using the reset voltage VC are carried out. The precharge driving and reset have been described above and thus will not be mentioned further here.

Next, capacitive driving is started, and the data line DL1 is driven by the data voltage SV1. Once a period T1 has elapsed following the start of the capacitive driving, the switching circuit SWAM of the voltage driving circuit 80 turns on, and the amplifier circuit AMVD drives the data line DL1 at a voltage equal to the data voltage SV1. Next, the switching element SWEP1 turns on (this may be at the same time as the switching circuit SWAM turns on), and the source line SL1 is connected to the data line DL1. As described above, the voltage at the data line DL1 becomes SV1', but because the data voltage SV1 is supplied by the voltage driving circuit 80, the data voltage SV1 is written to the source line SL1.

Next, the switching element SWEP1 turns off, and thereafter, the switching circuit SWAM of the voltage driving circuit 80 turns off. A period in which the switching circuit SWAM is on is a period T2 in which voltage driving is carried out.

Driving is carried out in the same manner for the source line SL9 as well. In other words, the capacitive driving is started after the voltage driving period T2 ends, and a data voltage SV9 is outputted to the data line DL1. Once the period T1 has elapsed, the switching circuit SWAM turns on, and the amplifier circuit AMVD drives the data line DL1 at a voltage equal to the data voltage SV9. Next, a switching element SWEP9 turns on, and the data voltage SV9 is written to the source line.

According to the second configuration example described thus far, the driver 100 includes the capacitor driving circuit 20, the capacitor circuit 10, and the voltage driving circuit 80.

The capacitor driving circuit 20 outputs first to tenth capacitor driving voltages (0 V or 15 V), corresponding to the tone data GD [10:1], to first to tenth capacitor driving nodes NDR1 to NDR10. The capacitor circuit 10 has the first to tenth capacitors C1 to C10 provided between the first to tenth capacitor driving nodes NDR1 to NDR10 and the data voltage output terminal TVQ. After starting the capacitive driving that drives the electro-optical panel 200 using the capacitor driving circuit 20 and the capacitor circuit 10, the voltage driving circuit 80 carries out voltage driving that outputs the data voltage corresponding to the tone data GD [10:1] to the data voltage output terminal TVQ.

Because capacitive driving outputs data voltages through charge redistribution between capacitors, there are cases where the accuracy of the data voltages becomes lower than when using an amplifier circuit, which is capable of supplying charges freely. For example, an error occurs in the data voltage when a source line precharged as described above is connected to a data line.

With respect to this point, according to this embodiment, the data voltage is outputted by the voltage driving circuit 80 after the capacitive driving has been started, and thus highly-accurate data voltage output is possible. In other words, the output voltage VQ can quickly approach the data voltage through the capacitive driving, and highly-accurate data voltages can be written to pixels by then carrying out voltage driving.

As described above, although the charge at the data voltage output node NVQ is not (strictly speaking) conserved when the data line and source line of the electro-optical panel 200 are connected, a charge is supplied through the voltage driving, and thus the state can ultimately be restored to a state in which a charge is conserved. In other words, a charge is conserved before the source line is connected, and the data voltage output node NVQ is at the voltage SV1 at that time. After the voltage of the data line DL1 has become SV1' due to the source line SL1 being connected, returning that voltage to SV1 returns the charge to a state occurring prior to the connection of the source line, and the capacitive driving can be carried out thereafter as being in a state where a charge is conserved.

At this time, the voltage driving circuit 80 supplies one source line's worth of charge, and thus the supplied charge is lower than in the case of driving with a board capacitance, a data line capacitance, or the like. In other words, the charge supply capabilities can be reduced as compared to a case where the driving is carried out using an amplifier circuit from the beginning without using capacitive driving. As such, power consumption can be suppressed even in the case of a high-resolution electro-optical panel 200 that requires high-speed settling.

As described above, high-speed settling is made possible by using capacitive driving, and a higher-resolution electro-optical panel 200 can be driven than in the case where the driving uses only an amplifier circuit. In addition, combining capacitive driving and voltage driving makes it possible to drive pixels with highly-accurate data voltages while suppressing power consumption.

In addition, in this embodiment, the voltage driving circuit 80 includes the amplifier circuit AMVD that outputs the data voltage, and the switching circuit SWAM provided between the output of the amplifier circuit AMVD and the data voltage output terminal TVQ.

Because capacitive driving is faster than driving using the amplifier circuit AMVD, the output voltage VQ is pulled toward the output of the amplifier circuit AMVD and approaches the data voltage more slowly when voltage driving and capacitive driving are carried out simultaneously. With respect to this point, according to this embodiment, the switching circuit SWAM is provided, and thus the output of the amplifier circuit AMVD and the data voltage output terminal TVQ can be disconnected. In other words, the data voltage can be outputted by disconnecting the output of the amplifier circuit AMVD and using high-speed capacitive driving.

In addition, in this embodiment, the switching circuit SWAM is off during the first period T1 spanning from the start of the capacitive driving to the start of the voltage driving, and is on during the second period T2 in which the voltage driving is carried out, as illustrated in FIG. 4.

By doing so, the voltage driving can be carried out after the capacitive driving has been started. In other words, after the switching circuit SWAM turns off and the voltage is quickly brought toward the data voltage through the capacitive driving in the first period T1, the switching circuit SWAM turns on and the highly-accurate output of the amplifier circuit AMVD can be connected to the data voltage output terminal TVQ in the second period T2. Through this, both high-speed capacitive driving and highly-accurate amplifier driving can be achieved.

In addition, in this embodiment, the driver 100 includes the reference voltage generation circuit 60 that generates the plurality of reference voltages VR1 to VR1024, and the D/A conversion circuit 70 that selects the reference voltage corresponding to the tone data GD [10:1] from among the plurality of reference voltages VR1 to VR1024 and outputs the selected reference voltage to the amplifier circuit AMVD. After the capacitive driving has been started, the amplifier circuit AMVD amplifies the reference voltage selected by the D/A conversion circuit 70 and outputs that voltage as the data voltage.

By doing so, the capacitive driving and the voltage driving can both output the data voltage corresponding to the tone data GD [10:1]. In addition, the reference voltages VR1 to VR1024 are generated by the reference voltage generation circuit 60 provided internally in the driver 100, and thus a more accurate data voltage can be outputted than with capacitive driving. In other words, a more accurate data voltage can be outputted by voltage driving, in which the data voltage is generated internally in the driver 100, than in capacitive driving, in which the data voltage is determined by a capacitance ratio relative to the electro-optical panel-side capacitance CP that is external to the driver 100.

Figure 15:
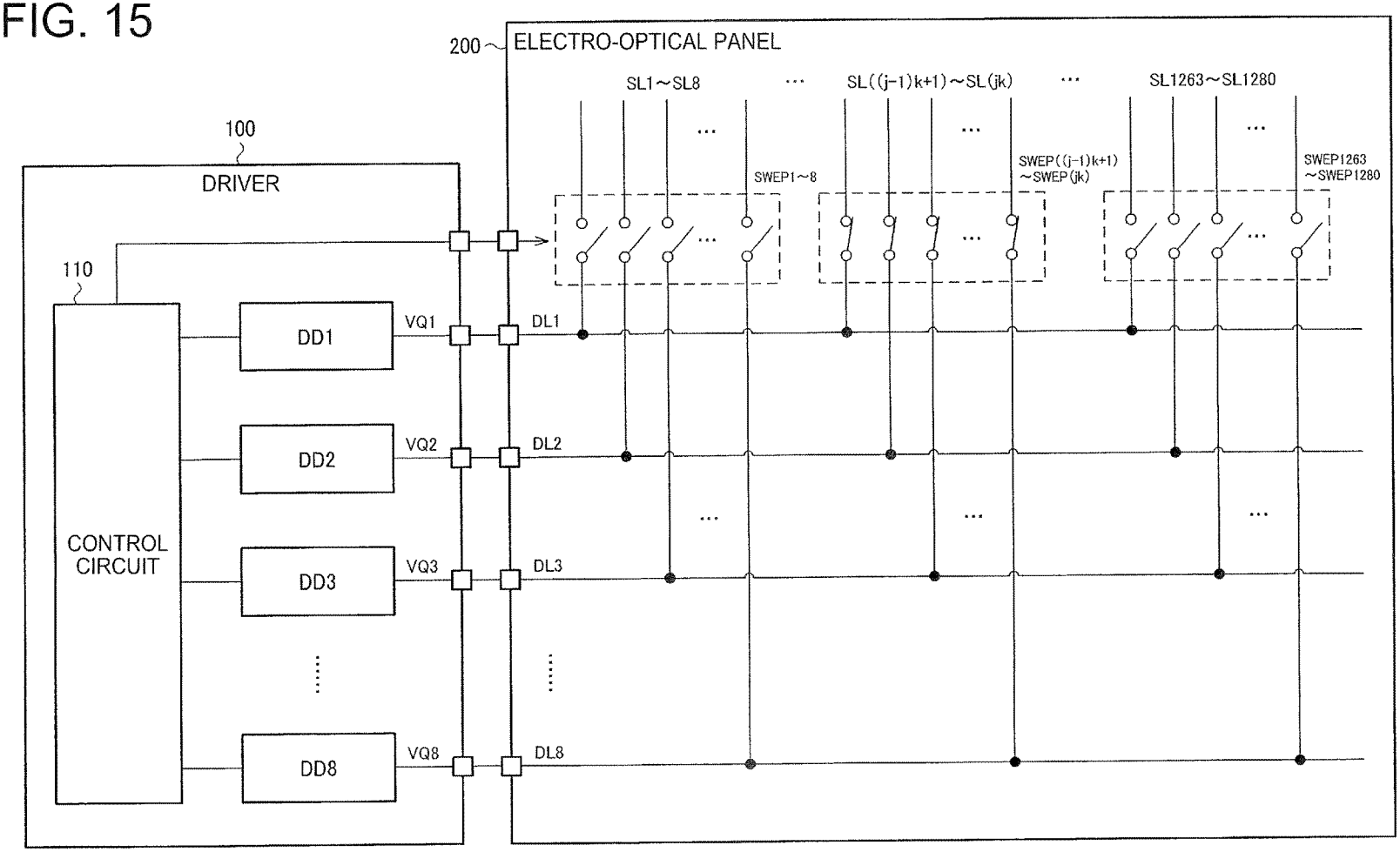
FIG. 15 illustrates a third example of the detailed configuration of a driver, an example of the detailed configuration of an electro-optical panel, and an example of the configuration of connections between the driver and the electro-optical panel.

In addition, in this embodiment, the electro-optical panel 200 includes the switching element SWEP1 provided between the data line DL1 and the source line SL1, as illustrated in FIG. 15. Furthermore, as illustrated in FIG. 4, the switching circuit SWAM of the voltage driving circuit 80 turns on after the start of capacitive driving and before the switching element SWEP1 of the electro-optical panel 200 turns on. Although the switching circuit SWAM turns on before the switching element SWEP1 turns on in FIG. 4, it should be noted that the switching circuit SWAM may turn on at the same time as the switching element SWEP1 turns on.

By doing so, the switching circuit SWAM turns on before the data line DL1 and the source line SL1 are connected by the switching element SWEP1, and the output of the amplifier circuit AMVD is connected to the data line DL1. The voltage of the data line DL1 varies due to the source line SL1 being connected (SV1 becomes SV1'), but by starting driving using the amplifier circuit AMVD before that time, the voltage of the source line SL1 can be restored to the data voltage SV1 as quickly as possible. As such, the source line SL1 can be settled at the data voltage SV1 in a limited amount of time.

Furthermore, in this embodiment, the switching circuit SWAM of the voltage driving circuit 80 turns off after the switching element SWEP1 of the electro-optical panel 200 has turned from on to off, as illustrated in FIG. 4.

The voltage of the source line SL1 of the electro-optical panel 200 is established when the switching element SWEP1 turns off. As such, by turning the switching circuit SWAM off after the switching element SWEP1 has turned from on to off, the voltage driving can be ended after the voltage of the source line SL1 has been established. Through this, the voltage of the source line can be established in a state in which the source line has been driven by a highly-accurate data voltage.

In addition, in this embodiment, a precharge amplifier circuit (AMPR, in FIG. 12) that outputs a prescribed precharge voltage VPR to the source line of the electro-optical panel 200 in a precharge period prior to capacitive driving (a period, in FIG. 4, in which both SWEP1 and SWEP9 are on), is provided.

By doing so, all of the source line voltages can be set to the precharge voltage before the data voltages are written to the source lines, and thus the quality of images displayed through this precharge driving can be improved.

As described with reference to FIG. 4, the precharge voltage VPR is written to the source line SL1 before capacitive driving is carried out, and the data line DL1 and the source line SL1 are connected after driving the data line DL1 with the data voltage SV1 in the capacitive driving. The voltages of the data line DL1 and the source line SL1 are different at this time, and thus the charge of the data line DL1 (a charge of the capacitance CO of the capacitor circuit 10 and the electro-optical panel-side capacitance CP (and a capacitance CA of a variable capacitance circuit 30)) is no longer conserved, causing error to arise in the data voltage SV1. With respect to this point, according to this embodiment, the source line SL1 is driven by the voltage driving circuit 80 with the data voltage SV1, and thus a highly-accurate data voltage SV1 can be written.

5. Third Example of Configuration of Driver

Next, consider again the data voltage in the first configuration example illustrated in FIG. 1. FIG. 2A assumes that the ratio between the capacitance CO of the capacitor circuit 10 and the electro-optical panel-side capacitance CP is set to 1:2, but a maximum value of the data voltage including cases where the ratio is not 1:2 will also be considered. As will be described hereinafter, if the driver 100 is to be created in a generic manner so as to be applicable in a variety of electro-optical panels 200, the ratio cannot be kept at 1:2, leading to a problem that the data voltage cannot be outputted in a constant range.

As illustrated in FIG. 5A, first, the capacitor circuit 10 is reset. In other words, "000h" is set for the tone data GD [10:1] (the h at the end indicates that the number within the " is a hexadecimal) and all of the outputs of the driving units DR1 to DR10 are set to 0 V. Meanwhile, the voltage VQ is set to VC=7.5 V, as indicated by Formula FA in FIG. 5A. In this reset, the entire charge accumulated in the capacitance CO of the capacitor circuit 10 and the electro-optical panel-side capacitance CP is conserved in the following data voltage output. Through this, data voltage that takes a reset voltage VC (a common voltage) as a reference is outputted.

As illustrated in FIG. 5B, the maximum value of the data voltage is outputted in the case where the tone data GD [10:1] is set to "3FFh" and the outputs of all of the driving units DR1 to DR10 are set to 15 V. The data voltage at this time can be found from the principle of the conservation of charge, and is a value indicated by Formula FB in FIG. 5B.

As illustrated in FIG. 5C, a desired data voltage range is assumed to be 5 V, for example. Because the reset voltage VC of 7.5 V is the reference, the maximum value is 12.5 V. This data voltage is realized when, based on the Formula FB, CO/(CO+CP)=1/3. In other words, relative to the electro-optical panel-side capacitance CP, the capacitance CO of the capacitor circuit 10 may be set to CP/2 (in other words, CP=2CO). The 5 V data voltage range can be realized by designing CO to be equal to CP/2 in this manner for a specific electro-optical panel 200 and a mounting board.

However, depending on the type of the electro-optical panel 200, the design of the mounting board, and so on, the electro-optical panel-side capacitance CP has a range of approximately 50 pF to 120 pF. Meanwhile, even with the same types of electro-optical panel 200 and mounting board, in the case where a plurality of electro-optical panels are connected (when connecting three R, G, and B electro-optical panels in a projector, for example), the lengths of wires for connecting the respective electro-optical panels to drivers differ, and thus the board capacitance CP1 will not necessary be the same.

For example, assume that the design is such that the capacitance CO of the capacitor circuit 10 for a given electro-optical panel 200 and mounting board is CP=2CO. In the case where a different type of electro-optical panel or mounting board is connected to this capacitor circuit 10, CP may become CO/2, 5CO, or the like. In the case where CP=CO/2, the maximum value of the data voltage will become 17.5 V, exceeding the power source voltage of 15 V, as illustrated in FIG. 5C. In this case, there is a problem not only in terms of the data voltage range but also in terms of the breakdown voltages of the driver 100, the electro-optical panel 200, and so on. Meanwhile, in the case where CP=5CO, the maximum value of the data voltage is 10 V, and thus a sufficient data voltage range cannot be achieved.

As such, in the case where the capacitance CO of the capacitor circuit 10 is set in accordance with the electro-optical panel-side capacitance CP, there is an issue that a dedicated design is necessary for the driver 100 with respect to the electro-optical panel 200, the mounting board, or the like. In other words, each time the type of the electro-optical panel 200, the design of the mounting board, or the like is changed, it is necessary to redesign the driver 100 specifically therefor.

Figure 6:
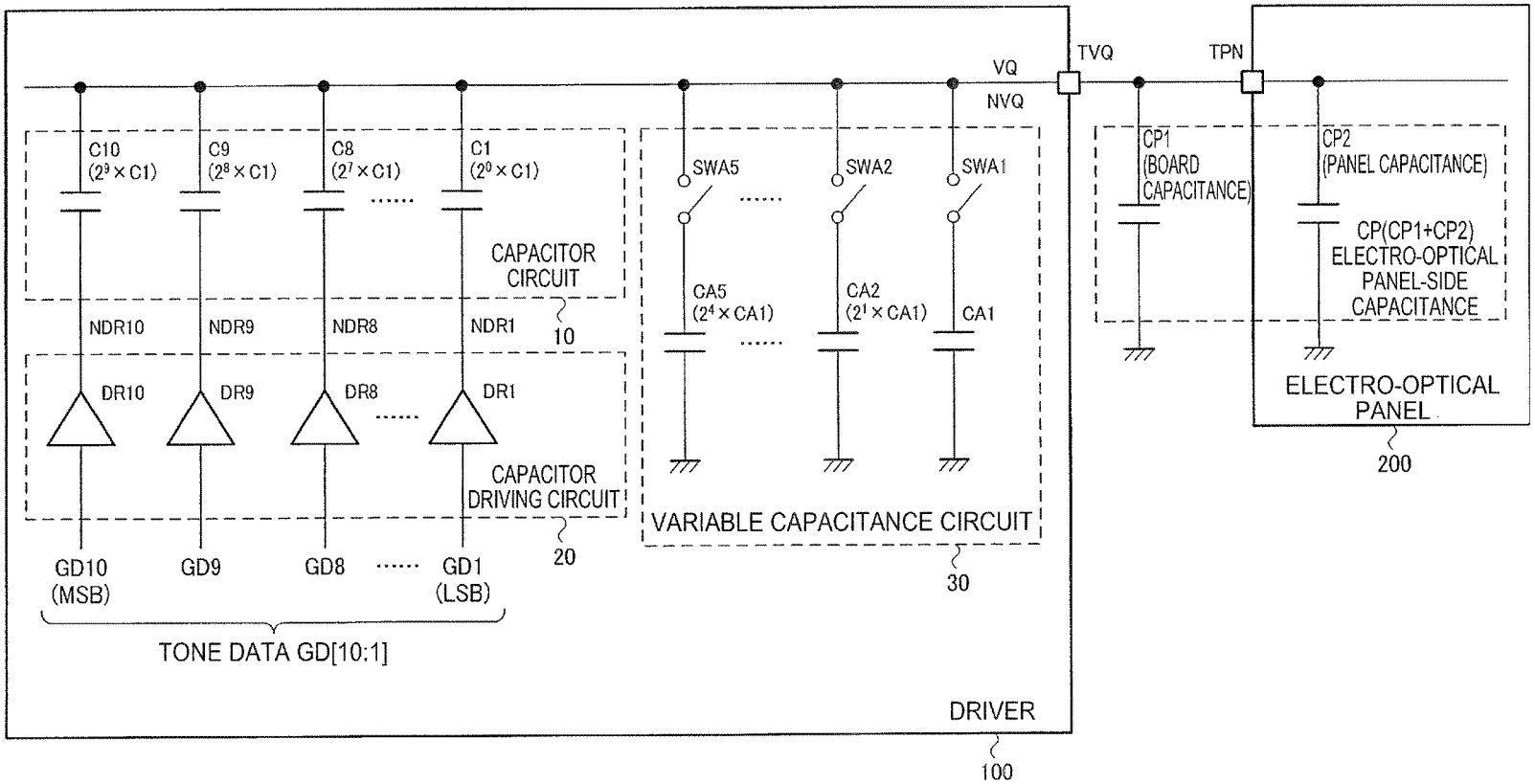
FIG. 6 illustrates a third example of the configuration of a driver.

FIG. 6 illustrates a third example of the configuration of a driver according to this embodiment, capable of solving the stated problem. This driver 100 includes the capacitor circuit 10, the capacitor driving circuit 20, and the variable capacitance circuit 30. Note that constituent elements that are the same as constituent elements already described are assigned the same reference numerals, and descriptions of those constituent elements are omitted as appropriate.

The variable capacitance circuit 30 is a circuit, serving as a capacitance connected to the data voltage output node NVQ, whose capacitance value can be set in a variable manner. Specifically, the variable capacitance circuit 30 includes first to mth switching elements SWA1 to SWAm (where m is a natural number of 2 or more), and first to mth adjusting capacitors CA1 to CAm. Note that the following will describe an example in which m=6.

The first to sixth switching elements SWA1 to SWA6 are configured as, for example, P-type or N-type MOS transistors, or as transfer gates that combine a P-type MOS transistor and an N-type MOS transistor. Of the switching elements SWA1 to SWA6, one end of an sth switching element SWAs (where s is a natural number no greater than m, which is 6) is connected to the data voltage output node NVQ.

The first to sixth adjusting capacitors CA1 to CA6 have capacitance values weighted by a power of 2. Specifically, of the adjusting capacitors CA1 to CA6, an sth adjusting capacitor CAs has a capacitance value of $2^{(s-1)}\times$CA1. One end of the sth adjusting capacitor CAs is connected to another end of the sth switching element SWAs. Another end of the sth adjusting capacitor CAs is connected to a low-potential side power source (broadly defined as a reference voltage node).

For example, in the case where CA1 is set to 1 pF, the capacitance of the variable capacitance circuit 30 is 1 pF while only the switching element SWA1 is on, whereas the capacitance of the variable capacitance circuit 30 is 63 pF (=1 pF+2 pF+ . . . +32 pF) while all the switching elements SWA1 to SWA6 are on. Because the capacitance values are weighted by a power of 2, the capacitance of the variable capacitance circuit 30 can be set from 1 pF to 63 pF in 1 pF (CA1) steps in accordance with whether the switching elements SWA1 to SWA6 are on or off.

6. Data Voltages in Third Configuration Example

Data voltages outputted by the driver 100 according to this embodiment will be described. Here, a range of the data voltages (a data voltage maximum value) will be described.

As illustrated in FIG. 7A, first, the capacitor circuit 10 is reset. In other words, the outputs of all the driving units DR1 to DR10 are set to 0 V and the voltage VQ is set to VC=7.5 V (Formula FC). In this reset, the entire charge accumulated in the capacitance CO of the capacitor circuit 10, a capacitance CA of the variable capacitance circuit, and the electro-optical panel-side capacitance CP is stored in the following data voltage output.

As illustrated in FIG. 7B, the maximum value of the data voltage is outputted in the case where the outputs of all of the driving units DR1 to DR10 are set to 15 V. The data voltage in this case is a value indicated by Formula FD in FIG. 7B.

As illustrated in FIG. 7C, a desired data voltage range is assumed to be 5 V, for example. The maximum value of 12.5 V for the data voltage is realized in the case where, from Formula FD, CO/(CO+(CA+CP))=1/3, or in other words, in the case where CA+CP=2CO. CA is the capacitance of the variable capacitance circuit, and can thus be set freely, which in turn means that the CA can be set to 2CO−CP for the provided CP. In other words, regardless of the type of the electro-optical panel 200 connected to the driver 100, the design of the mounting board, or the like, the data voltage range can always be set to 7.5 V to 12.5 V.

According to the third configuration example described thus far, the driver 100 includes the variable capacitance circuit 30. The variable capacitance circuit 30 is provided between the data voltage output terminal TVQ and a node at a reference voltage (the voltage of the low-potential side power source, namely 0 V). Then, the capacitance CA of the variable capacitance circuit 30 is set so that a capacitance CA+CP obtained by adding the capacitance CA of the variable capacitance circuit 30 and the electro-optical panel-side capacitance CP (this will be called a "driven-side capacitance" hereinafter) and the capacitance CO of the capacitor circuit 10 (this will be called a "driving-side capacitance" hereinafter) have a prescribed capacitance ratio relationship (CO:(CA+CP)=1:2, for example).

Here, the capacitance CA of the variable capacitance circuit 30 is a capacitance value set for the variable capacitance of the variable capacitance circuit 30. In the example of FIG. 6, this is obtained by taking the total of the capacitances of the adjusting capacitors connected to switching elements, of the switching elements SWA1 to SWA6, that are on. Meanwhile, the electro-optical panel-side capacitance CP is a capacitance externally connected to the data voltage output terminal TVQ (parasitic capacitance, circuit element capacitance). In the example illustrated in FIG. 6, this is the board capacitance CP1 and the panel capacitance CP2. Meanwhile, the capacitance CO of the capacitor circuit 10 is the total of the capacitances of the capacitors C1 to C10.

The prescribed capacitance ratio relationship refers to a relationship in a ratio between the driving-side capacitance CO and the driven-side capacitance CA+CP. This is not limited to a capacitance ratio in the case where the values of each capacitance are measured (where the capacitance value are explicitly determined). For example, the capacitance ratio may be estimated from the output voltage VQ for prescribed tone data GD [10:1]. The electro-optical panel-side capacitance CP is normally not a measured value obtained in advance, and thus the capacitance CA of the variable capacitance circuit 30 cannot be determined directly. Accordingly, as will be described later with reference to FIG. 10, the capacitance CA of the variable capacitance circuit 30 is determined so that, for example, a VQ of 10 V is outputted for a median value "200h" of the tone data GD [10:1]. In this case, the capacitance ratio is ultimately estimated as being CO:(CA+CP)=1:2, and the capacitance CP can be estimated from this ratio and the capacitance CA (can be estimated, but the capacitance CP need not be known).

In the first configuration example illustrated in FIG. 1 and the like, there is an issue in that a design change is necessary each time the connection environment of the driver 100 (the design of the mounting board, the type of the electro-optical panel 200, or the like) changes.

With respect to this point, according to the third configuration example, a generic driver 100 that does not depend on the connection environment of the driver 100 can be realized by providing the variable capacitance circuit 30. In other words, even in the case where the electro-optical panel-side capacitance CP is different, the prescribed capacitance ratio relationship (for example, CO:(CA+CP)=1:2) can be realized by adjusting the capacitance CA of the variable capacitance circuit 30 in accordance therewith. The data voltage range (7.5 V to 12.5 V in the example illustrated in FIGS. 7A to 7C) is determined by this capacitance ratio relationship, and thus a data voltage range that does not depend on the connection environment can be realized.

Meanwhile, in the capacitive driving carried out by the capacitor circuit 10 and the capacitor driving circuit 20, the pixels are driven by charge redistribution, and thus the data voltages can be written to the pixels at higher speeds than through amplifier driving (that is, the data voltages are settled in a short amount of time). Because higher speeds are possible, an electro-optical panel having a higher number of pixels (that is, a higher resolution) can be driven. In capacitive driving, charges are not supplied freely in the same manner as amplifier driving, but providing the variable capacitance circuit 30 makes it possible to adjust the charges supplied to the pixels. In other words, by providing the variable capacitance circuit 30, higher speeds can be realized through capacitive driving, and desired data voltages can be outputted.

In addition, in this embodiment, the capacitor driving circuit 20 outputs the first voltage level (0 V) or the second voltage level (15 V) as driving voltages corresponding to the respective first to tenth capacitor driving voltages, based on the first to tenth bits GD1 to GD10 of the tone data GD [10:1]. The prescribed capacitance ratio relationship is determined by a voltage relationship between a voltage difference between the first voltage level and the second voltage level (15 V) and the data voltage outputted to the data voltage output terminal TVQ (the output voltage VQ).

In the example illustrated in FIGS. 7A to 7C, the range of data voltages outputted to the data voltage output terminal TVQ is 5 V (7.5 V to 12.5 V), for example. In this case, the prescribed capacitance ratio relationship is determined so that the voltage relationship is realized between the voltage difference between the first voltage level and the second voltage level (15 V) and the data voltage range (5 V). In other words, a capacitance ratio of CO:(CA+CP)=1:2 at which 15 V is divided to 5 V through voltage division by the capacitance CO and the capacitance CA+CP becomes the prescribed capacitance ratio relationship.

By doing so, the prescribed capacitance ratio relationship of CO:(CA+CP)=1:2 can be determined from the voltage relationship between the voltage difference between the first voltage level and the second voltage level (15 V) and the range of data voltages outputted to the data voltage output terminal TVQ (a range of 5 V). Conversely, whether or not the prescribed capacitance ratio relationship is realized can be determined by examining the voltage relationship. In other words, even if the electro-optical panel-side capacitance CP is not known, the capacitance CA of the variable capacitance circuit 30 at which the capacitance ratio of CO:(CA+CP)=1:2 is realized can be determined from the voltage relationship (the flow illustrated in FIG. 10, for example).

7. Detailed Example of Configuration of Driver

FIG. 8 illustrates a detailed example of the configuration of the driver according to this embodiment. This driver 100 includes a data line driving circuit 110, the reference voltage generation circuit 60, and the control circuit 40. The data line driving circuit 110 includes the D/A conversion circuit 70, the voltage driving circuit 80, a capacitive driving circuit 90, and a detection circuit 50. The capacitive driving circuit 90 includes the capacitor circuit 10, the capacitor driving circuit 20, and the variable capacitance circuit 30. The control circuit 40 includes a data output circuit 42, an interface circuit 44, a variable capacitance control circuit 46, and a register unit 48. Note that constituent elements that are the same as constituent elements already described are assigned the same reference numerals, and descriptions of those constituent elements are omitted as appropriate.

A single data line driving circuit 110 is provided corresponding to a single data voltage output terminal TVQ. Although the driver 100 includes a plurality of data line driving circuits and a plurality of data voltage output terminals, only one is illustrated in FIG. 8. The reference voltage generation circuit 60 is provided in common for the plurality of data line driving circuits (a plurality of D/A conversion circuits).

The interface circuit 44 carries out an interfacing process between a display controller 300 (broadly defined as a processing unit) that controls the driver 100 and the driver 100. For example, the interfacing process is carried out through serial communication such as LVDS (Low Voltage Differential Signaling) or the like. In this case, the interface circuit 44 includes an I/O circuit that inputs/outputs serial signals and a serial/parallel conversion circuit that carries out serial/parallel conversion on control data, image data, and so on. Meanwhile, a line latch that latches the image data inputted from the display controller 300 and converted into parallel data is also included. The line latch latches image data corresponding to a single horizontal scanning line at one time, for example.

The data output circuit 42 extracts the tone data GD [10:1] to be outputted to the capacitor driving circuit 20 from the image data corresponding to the horizontal scanning line, and outputs this data as data DQ[10:1] and DQ2[10:1]. The data DQ2[10:1] is outputted to the D/A conversion circuit 70. The data output circuit 42 includes, for example, a timing controller that controls a driving timing of the electro-optical panel 200, a selection circuit that selects the tone data GD [10:1] from the image data corresponding to the horizontal scanning line, an output latch that latches the selected tone data GD [10:1] as the data DQ[10:1], and an output latch that latches the selected tone data GD [10:1] as the data DQ2 [10:1]. As will be described later with reference to FIG. 15 and so on, in the case of phase expansion driving, the output latch latches eight pixels' worth of the tone data GD [10:1] (equivalent to the number of data lines DL1 to DL8) at one time. In this case, the timing controller controls the operational timing of the selection circuit, the output latch, and so on in accordance with the driving timing of the phase expansion driving. Meanwhile, a horizontal synchronization signal, a vertical synchronization signal, and so on may be generated based on the image data received by the interface circuit 44. Furthermore, a signal (ENBX) for controlling the switching elements (SWEP1 and the like) in the electro-optical panel 200 on and off, a signal for controlling gate driving (selection of horizontal scanning lines in the electro-optical panel 200), and so on may be outputted to the electro-optical panel 200.

The detection circuit 50 detects the voltage VQ at the data voltage output node NVQ. Specifically, the detection circuit 50 compares a prescribed detection voltage with the voltage VQ and outputs a result thereof as a detection signal DET. For example, DET="1" is outputted in the case where the voltage VQ is greater than or equal to the detection voltage, and DET="0" is outputted in the case where the voltage VQ is less than the detection voltage.

The variable capacitance control circuit 46 sets the capacitance of the variable capacitance circuit 30 based on the detection signal DET. The flow of this setting process will be described later with reference to FIG. 10. The variable capacitance control circuit 46 outputs a setting value CSW[6:1] as a control signal for the variable capacitance circuit 30. This setting value CSW[6:1] is constituted of first to sixth bits CSW1 to CSW6 (first to mth bits). A bit CSWs (where s is a natural number no greater than m, which is 6) is inputted into the switching element SWAs of the variable capacitance circuit 30. For example, in the case where the bit CSWs="0", the switching element SWAs turns off, whereas in the case where the bit CSWs="1", the switching element SWAs turns on. In the case where the setting process is carried out, the variable capacitance control circuit 46 outputs detection data BD[10:1]. Then, the data output circuit 42 outputs the detection data BD[10:1] to the capacitor driving circuit 20 as the output data DQ[10:1].

The register unit 48 stores the setting value CSW[6:1] of the variable capacitance circuit 30 set through the setting process. The register unit 48 is configured to be accessible from the display controller 300 via the interface circuit 44. In other words, the display controller 300 can read out the setting value CSW[6:1] from the register unit 48. Alternatively, the configuration may be such that the display controller 300 can write the setting value CSW[6:1] into the register unit 48.

Figure 9:
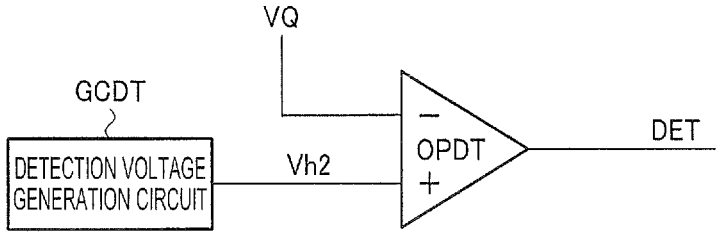
FIG. 9 illustrates an example of the detailed configuration of a detection circuit.

FIG. 9 illustrates an example of the detailed configuration of the detection circuit 50. The detection circuit 50 includes a detection voltage generation circuit GCDT that generates a detection voltage Vh2 and a comparator OPDT that compares the voltage VQ at the data voltage output node NVQ with the detection voltage Vh2.

The detection voltage generation circuit GCDT outputs the detection voltage Vh2, which is determined in advance by a voltage division circuit or the like using a resistance element, for example. Alternatively, a variable detection voltage Vh2 may be outputted through register settings or the like. In this case, the detection voltage generation circuit GCDT may be a D/A conversion circuit that D/A-converts a register setting value.

8. Process for Setting Capacitance of Variable Capacitance Circuit

Figure 10:
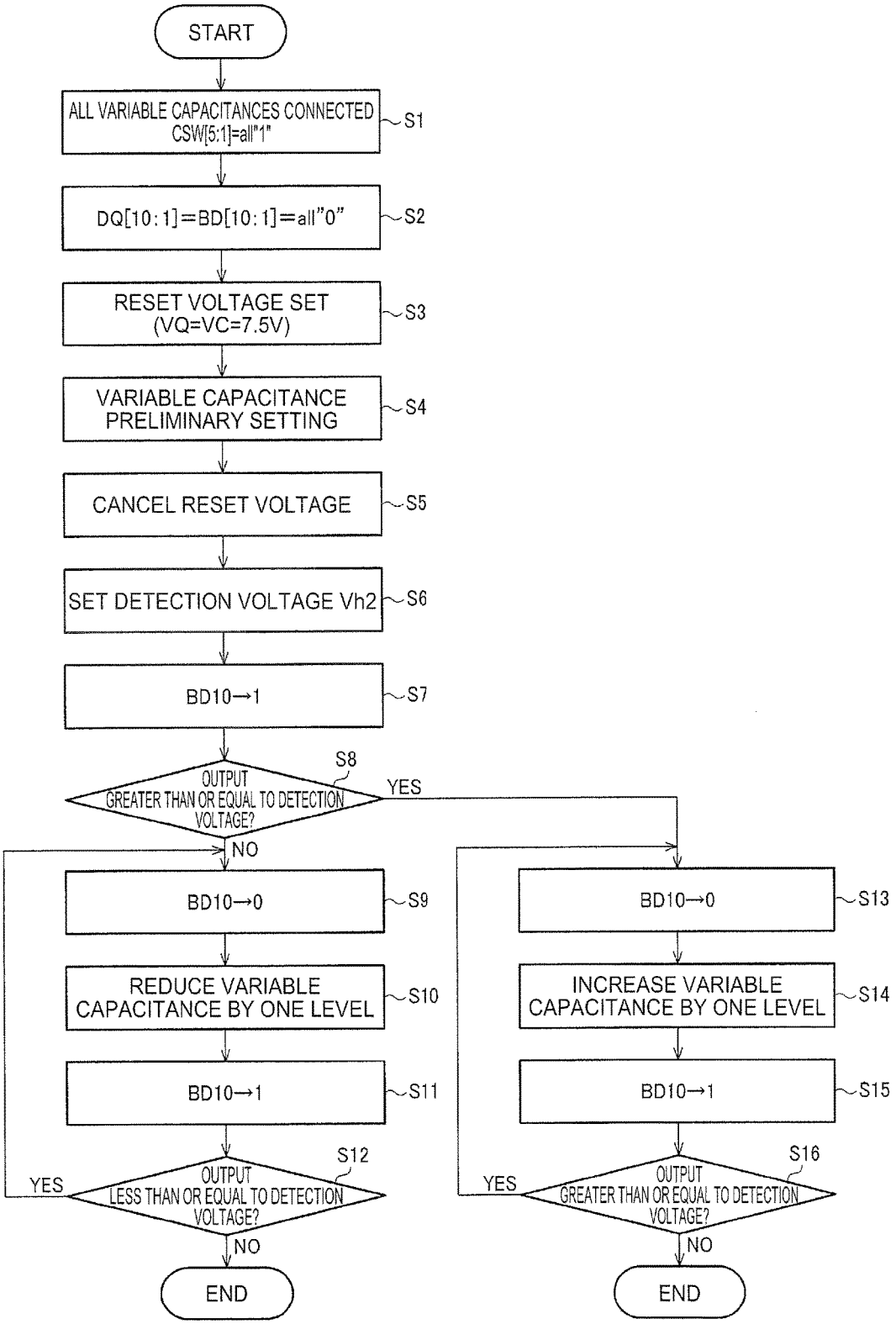
FIG. 10 is a flowchart illustrating a process for setting a capacitance of a variable capacitance circuit.

FIG. 10 is a flowchart illustrating a process for setting the capacitance of the variable capacitance circuit 30. This process is carried out, for example, during startup (an initialization process) when the power of the driver 100 is turned on.

As illustrated in FIG. 10, when the process starts, the setting value CSW[6:1] of "3Fh" is outputted, and all of the switching elements SWA1 to SWA6 of the variable capacitance circuit 30 are turned on (step S1). Next, the detection data BD[10:1] of "000h" is outputted, and the outputs of all of the driving units DR1 to DR10 of the capacitor driving circuit 20 are set to 0 V (step S2). Next, the output voltage VQ is set to the reset voltage VC of 7.5 V (step S3). This reset voltage VC is supplied, for example, from the exterior via the terminal TVC, which will be described later with reference to FIG. 12.

Next, the capacitance of the variable capacitance circuit 30 is preliminarily set (step S4). For example, the setting value CSW[6:1] is set to "1Fh". In this case, the switching element SWA6 turns off and the switching elements SWA5 to SWA1 turn on, and thus the capacitance is half the maximum value. Next, the supply of the reset voltage VC to the output voltage VQ is canceled (step S5). Then, the detection voltage Vh2 is set to a desired voltage (step S6). For example, the detection voltage Vh2 is set to 10 V.

Next, the MSB of the detection data BD[10:1] is changed from BD10="0" to BD10="1" (step S7). Then, it is detected whether or not the output voltage VQ is greater than or equal to the detection voltage Vh2 of 10 V (step S8).

In the case where the output voltage VQ is less than the detection voltage Vh2 of 10 V in step S8, the bit BD10 is returned to "0" (step S9). Next, 1 is subtracted from the setting value CSW[6:1] of "1Fh" for "1Eh" and the capacitance of the variable capacitance circuit 30 is lowered by one level (step S10). Next, the bit BD10 is set to "1" (step S11). Then, it is detected whether or not the output voltage VQ is less than or equal to the detection voltage Vh2 of 10 V (step S12). The process returns to step S9 in the case where the output voltage VQ is less than or equal to the detection voltage Vh2 of 10 V, and the process ends in the case where the output voltage VQ is greater than the detection voltage Vh2 of 10 V.

In the case where the output voltage VQ is greater than or equal to the detection voltage Vh2 of 10 V in step S8, the bit BD10 is returned to "0" (step S13). Next, 1 is added to the setting value CSW[6:1] of "1Fh" for "20h" and the capacitance of the variable capacitance circuit 30 is raised by one level (step S14). Next, the bit BD10 is set to "1" (step S15). Then, it is detected whether or not the output voltage VQ is greater than or equal to the detection voltage Vh2 of 10 V (step S16). The process returns to step S13 in the case where the output voltage VQ is greater than or equal to the detection voltage Vh2 of 10 V, and the process ends in the case where the output voltage VQ is less than the detection voltage Vh2 of 10 V.

FIGS. 11A and 11B schematically illustrate the setting value CSW[6:1] being determined through the stated steps S8 to S16.

In the aforementioned flow, the MSB of the detection data BD[10:1] is set to BD10="1", and the output voltage VQ at that time is compared to the detection voltage Vh2 of 10 V. BD[10:1]="200h" is a median value of the tone data range "000h" to "3FFh", and the detection voltage Vh2 of 10 V is a median value of the data voltage range of 7.5 V to 12.5 V. In other words, if the output voltage VQ matches the detection voltage Vh2 of 10 V when BD10="1", the correct (desired) data voltage is obtained.

As illustrated in FIG. 11A, in the case of "NO" in step S8 for the preliminary setting value CSW[6:1]="1Fh", VQ<Vh2. In this case, it is necessary to raise the output voltage VQ. From Formula FD in FIG. 7B, it can be seen that the output voltage VQ will rise if the capacitance CA of the variable capacitance circuit 30 is reduced, and thus the setting value CSW[6:1] is reduced by "1" at a time. The setting value CSW[6:1] stops at "1Ah", where VQ≥Vh2 for the first time. Through this, the setting value CSW[6:1] at which the output voltage VQ nearest to the detection voltage Vh2 is obtained can be determined.

As illustrated in FIG. 11B, in the case of "YES" in step S8 for the preliminary setting value CSW[6:1]="1Fh", VQ≥Vh2. In this case, it is necessary to lower the output voltage VQ. From Formula FD in FIG. 7B, it can be seen that the output voltage VQ will drop if the capacitance CA of the variable capacitance circuit 30 is increased, and thus the setting value CSW[6:1] is increased by "1" at a time. The setting value CSW[6:1] stops at "24h", where VQ<Vh2 for the first time. Through this, the setting value CSW[6:1] at which the output voltage VQ nearest to the detection voltage Vh2 is obtained can be determined.

The setting value CSW[6:1] obtained through the above processing is determined as the final setting value CSW[6:1], and that setting value CSW[6:1] is written into the register unit 48. When driving the electro-optical panel 200 through capacitive driving, the capacitance of the variable capacitance circuit 30 is set using the setting value CSW[6:1] stored in the register unit 48.

Although this embodiment describes an example in which the setting value CSW[6:1] of the variable capacitance circuit 30 is stored in the register unit 48, the invention is not limited thereto. For example, the setting value CSW[6:1] may be stored in a memory such as a RAM or the like, or the setting value CSW[6:1] may be set using a fuse (for example, setting the setting value through cutting by a laser or the like during manufacture).

9. Second Detailed Example of Configuration of Driver

Figure 12:
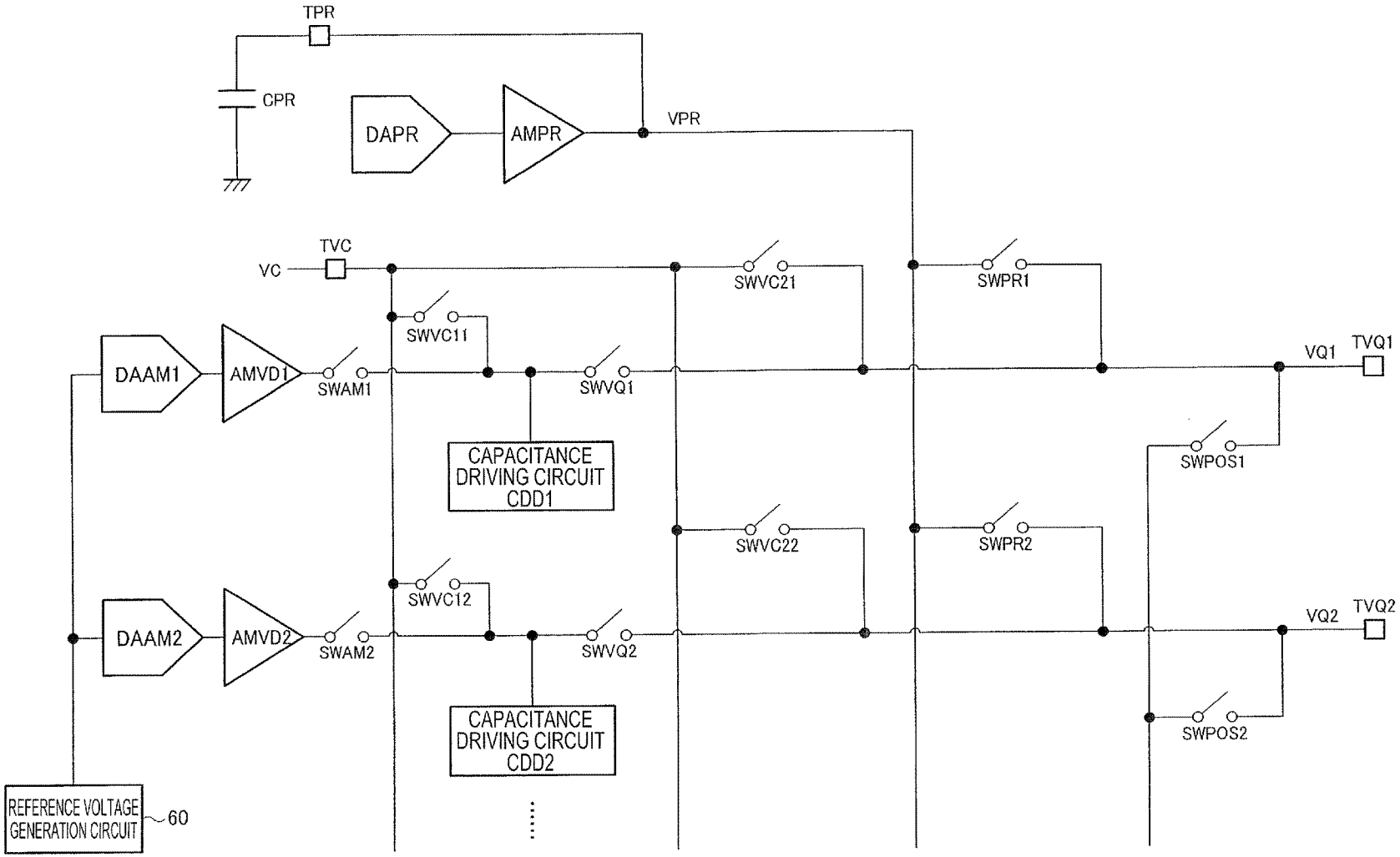
FIG. 12 illustrates a second example of the detailed configuration of a driver.

FIG. 12 illustrates a second example of the detailed configuration of the driver 100 according to this embodiment. The driver 100 includes: amplifier circuits AMVD1 and AMVD2; D/A conversion circuits DAAM1 and DAAM2; switching circuits SWAM1 and SWAM2; the reference voltage generation circuit 60; a precharge terminal TPR; the reset voltage terminal TVC (a common voltage terminal); data voltage output terminals TVQ1 and TVQ2; a precharge D/A conversion circuit DAPR; a precharge amplifier circuit AMPR; capacitive driving circuits CDD1 and CDD2; precharge switching elements SWPR1 and SWPR2; reset switching elements SWVC11, SWVC12, SWVC21, and SWVC22; output switching elements SWVQ1 and SWVQ2; and postcharge switching elements SWPOS1 and SWPOS2.

The capacitive driving circuit CDD1, the D/A conversion circuit DAAM1, the amplifier circuit AMVD1, and the switching circuit SWAM1 correspond to the data line driving circuit 110 illustrated in FIG. 8. Likewise, the capacitive driving circuit CDD2, the D/A conversion circuit DAAM2, the amplifier circuit AMVD2, and the switching circuit SWAM2 correspond to the data line driving circuit 110 illustrated in FIG. 8. Although only two are illustrated in FIG. 12, in reality, the driver 100 has the same number (or more) of data line driving circuits as there are data lines in the electro-optical panel 200. Likewise, the numbers of data voltage output terminals, various types of switching elements, and so on are the same as the number of data line driving circuits.

The reset voltage VC (common voltage) is supplied to the reset voltage terminal TVC from an external power source circuit or the like, for example.

Note that the method for supplying the reset voltage VC is not limited to the reset voltage terminal TVC. For example, the driver 100 may include a reset voltage amplifier circuit that outputs the reset voltage VC.

The precharge terminal TPR is connected to an output of the precharge amplifier circuit AMPR. The precharge D/A conversion circuit DAPR D/A-converts a precharge setting value (a register value, for example) and generates the precharge voltage VPR, and the precharge amplifier circuit AMPR drives the precharge terminal TPR using the precharge voltage VPR. The precharge voltage VPR is a voltage that is lower than the reset voltage VC, for example (within a data voltage range of 7.5 V to 2.5 V in negative-polarity driving).

An external precharge capacitor CPR is connected to the precharge terminal TPR. The precharge capacitor CPR accumulates a charge corresponding to the precharge voltage VPR, and supplies the charge to the data line during a precharge. The precharge voltage VPR can be smoothed by providing the precharge capacitor CPR, and thus the charge supply performance of the precharge amplifier circuit AMPR can be reduced. In other words, although the precharge capacitor CPR emits a charge when the precharge is carried out, it is sufficient that the precharge amplifier circuit AMPR can replenish the charge in the precharge capacitor CPR before the next precharge is carried out.

Figure 13:
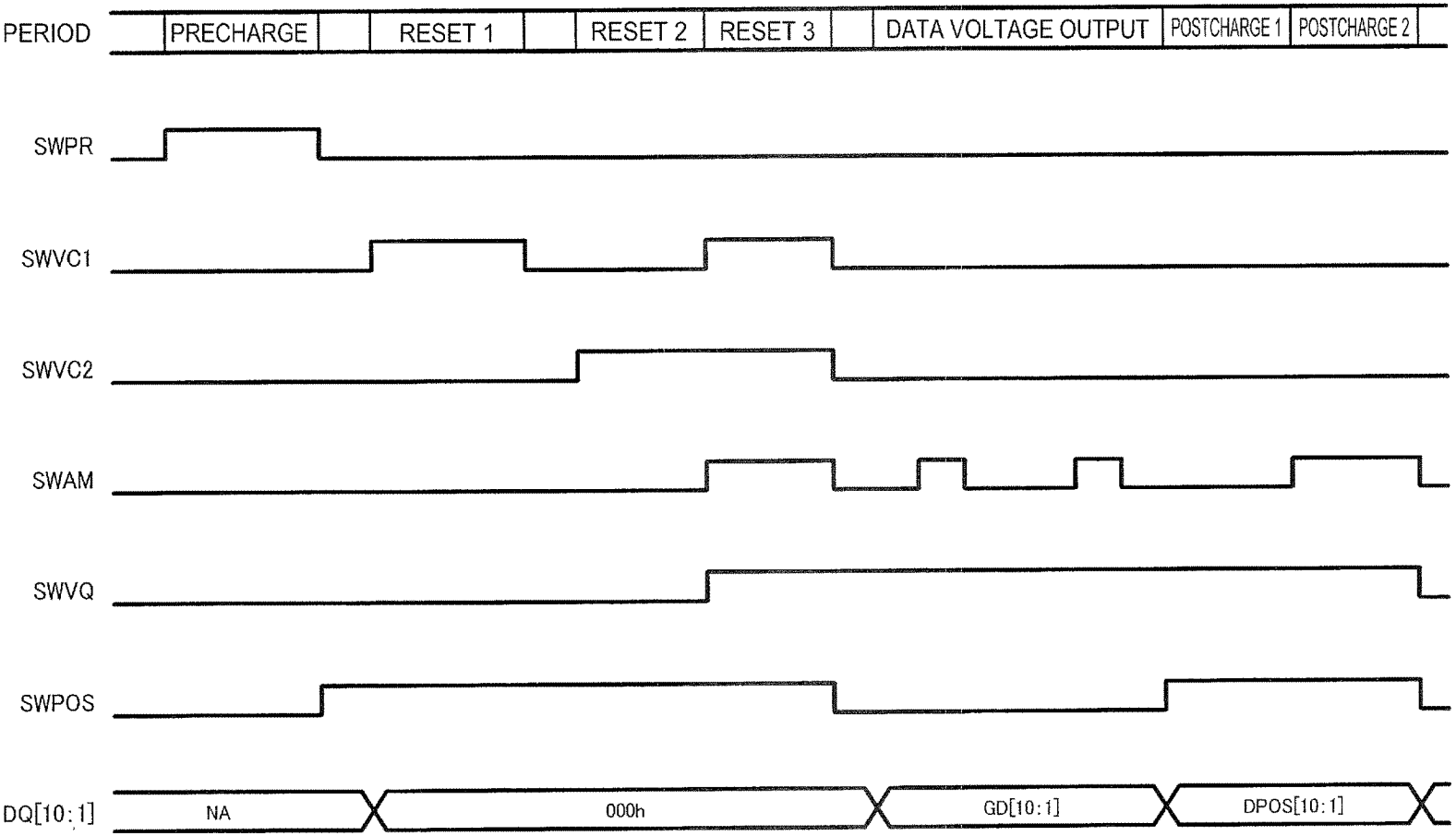
FIG. 13 is an operational timing chart of the second detailed configuration example.

FIG. 13 is an operational timing chart of the second detailed example of the configuration of the driver 100. In FIG. 13, numbers at the ends of the reference numerals of the switching element have been omitted. For example, "SWPR" indicates the precharge switching elements SWPR1 and SWPR2. In the timing chart for the switching elements, high-level indicates a state in which a switching element is on, and low-level indicates a state in which the switching element is off.

As illustrated in FIG. 13, the driving of the electro-optical panel 200 is carried out in the order of precharge, reset, data voltage output, and postcharge. This series of operations is carried out in a single horizontal scanning period, for example.

In a precharge period, the precharge switching elements SWPR1 and SWPR2 turn on, and the precharge voltage VPR is outputted from the data voltage output terminals TVQ1 and TVQ2.

A reset period is divided into first to third reset periods. In the first to third reset periods, DQ[10:1] is set to "000h" (DQ2[10:1]="000h"), and the driving units DR1 to DR10 of the capacitor driving circuit 20 all output 0 V. The amplifier circuits AMVD1 and AMVD2 output the reset voltage VC.

In the first reset period, the reset switching elements SWVC11 and SWVC12 turn on, and the outputs of the capacitive driving circuits CDD1 and CDD2 (one end of the capacitors C1 to C10) are set to the reset voltage VC. Through this, the charges in the capacitor circuit 10 and the variable capacitance circuit 30 are reset. Meanwhile, the postcharge switching elements SWPOS1 and SWPOS2 turn on, and the data voltage output terminals TVQ1 and TVQ2 are connected in common.

In the second reset period, the reset switching elements SWVC21 and SWVC22 and the postcharge switching elements SWPOS1 and SWPOS2 turn on, and the reset voltage VC is outputted from the data voltage output terminals TVQ1 and TVQ2. Through this, the charge in the electro-optical panel-side capacitance CP is reset.

In the third reset period, the output switching elements SWVQ1 and SWVQ2 and the switching circuits SWAM1 and SWAM2 turn on; an output of the amplifier circuit AMVD1, an output of the capacitive driving circuit CDD1, and the data voltage output terminal TVQ1 are connected;

and an output of the amplifier circuit AMVD2, an output of the capacitive driving circuit CDD2, and the data voltage output terminal TVQ2 are connected. In addition, the reset switching elements SWVC11, SWVC12, SWVC21, and SWVC22 and the postcharge switching elements SWPOS1 and SWPOS2 turn on, and the reset voltage VC is outputted from the data voltage output terminals TVQ1 and TVQ2.

In a data voltage output period, DQ[10:1] is set to GD[10:1] (DQ2[10:1] is set to GD[10:1]). Then, the output switching elements SWVQ1 and SWVQ2 turn on, and data voltages corresponding to the tone data GD [10:1] are outputted from the data voltage output terminals TVQ1 and TVQ2. Details of the data voltage output period will be given later.

A postcharge period is divided into a first postcharge period and a second postcharge period. In the first postcharge period and the second postcharge period, DQ[10:1] is set to DPOS[10:1] (DQ2[10:1] is set to DPOS[10:1]). DPOS[10:1] is postcharge data.

In the first postcharge period, the output switching elements SWVQ1 and SWVQ2 and the postcharge switching elements SWPOS1 and SWPOS2 turn on, and a data voltage corresponding to the postcharge data DPOS[10:1] is outputted from the data voltage output terminals TVQ1 and TVQ2.

In the second postcharge period, the switching circuits SWAM1 and SWAM2 also turn on, and the amplifier circuits AMVD1 and AMVD2 output a data voltage corresponding to the postcharge data DPOS[10:1] to the data voltage output terminals TVQ1 and TVQ2.

Figure 14:
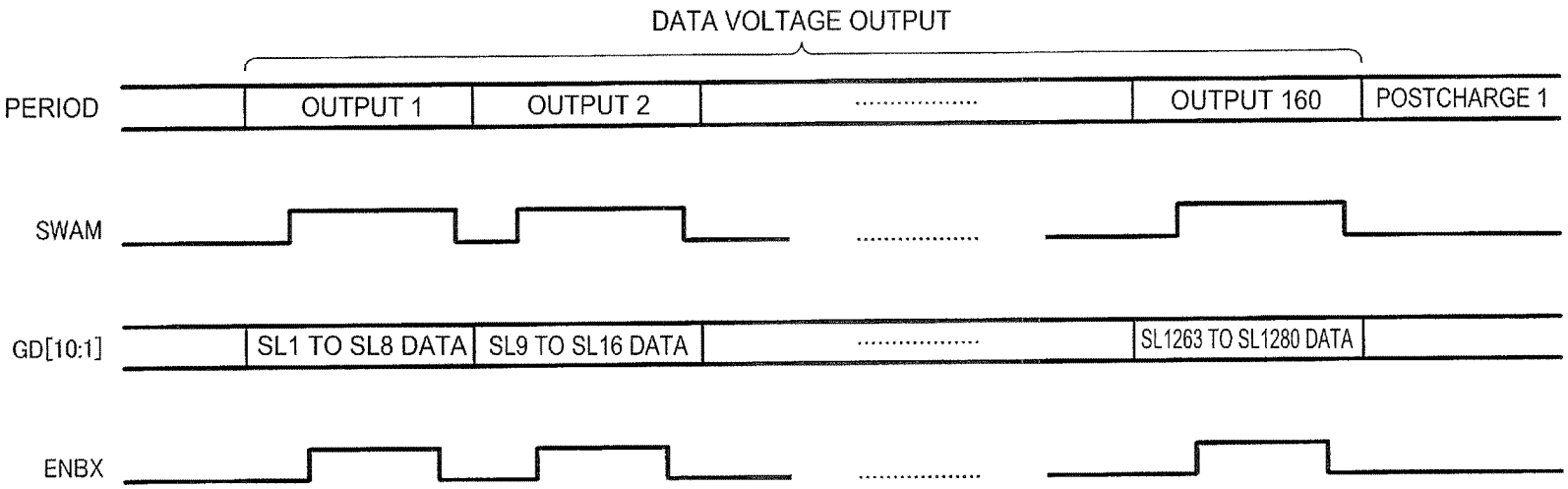
FIG. 14 is an operational timing chart of the second detailed configuration example.

FIG. 14 is an operational timing chart illustrating the data voltage output period. The data voltage output period is divided into first to 160th output periods. Note that the following describes an example in which the electro-optical panel 200 has the configuration illustrated in FIG. 15.

In the first output period, tone data corresponding to the source lines SL1 to SL8 is outputted as the tone data GD [10:1]. For example, a timing at which the tone data is latched by the output latch of the data output circuit 42 corresponds to the timing when capacitive driving starts. The switching circuits SWAM1 and SWAM2 turn on after the tone data corresponding to the source lines SL1 to SL8 has been latched, and the amplifier circuits AMVD1 and AMVD2 output data voltages corresponding to the tone data.

The signal ENBX is on (active) in the period the switching circuits SWAM1 and SWAM2 are on (a voltage driving period), and the source lines SL1 to SL8 of the electro-optical panel 200 are driven. The signal ENBX is a control signal for controlling the switching elements that connect the data lines and source lines in the electro-optical panel 200 to turn on and off.

After the switching circuits SWAM1 and SWAM2 have turned off, the following second output period is transited to. In the second output period, tone data corresponding to the source lines SL9 to SL16 is outputted as the tone data GD [10:1]. Next, the switching circuits SWAM1 and SWAM2 turn on, the signal ENBX turns on (active), and the source lines SL9 to SL16 of the electro-optical panel 200 are driven. Corresponding operations are carried out in the third to 160th output periods, and the first postcharge period is then transited to.

10. Phase Expansion Driving Method

Next, a method of driving the electro-optical panel 200 will be described. The following describes an example of phase expansion driving, but the method of driving carried out by the driver 100 in this embodiment is not limited to phase expansion driving.

FIG. 15 illustrates a third example of the detailed configuration of a driver, an example of the detailed configuration of an electro-optical panel, and an example of the configuration of connections between the driver and the electro-optical panel.

The driver 100 includes the control circuit 40 and first to kth data line driving circuits DD1 to DDk (where k is a natural number of 2 or more). The data line driving circuits DD1 to DDk each correspond to the data line driving circuit 110 illustrated in FIG. 8. Note that the following will describe an example in which k=8.

The control circuit 40 outputs corresponding tone data to each data line driving circuit in the data line driving circuits DD1 to DD8. The control circuit 40 also outputs a control signal (for example, ENBX illustrated in FIG. 16 or the like) to the electro-optical panel 200.

The data line driving circuits DD1 to DD8 convert the tone data into data voltages, and output those data voltages to the data lines DL1 to DL8 of the electro-optical panel 200 as output voltages VQ1 to VQ8.

The electro-optical panel 200 includes the data lines DL1 to DL8 (first to kth data lines), switching elements SWEP1 to SWEP(tk), and source lines SL1 to SL(tk). t is a natural number of 2 or more, and the following will describe an example in which t=160 (in other words, tk=160×8=1,280 (WXGA)).

Of the switching elements SWEP1 to SWEP1280, one end of each of the switching elements SWEP((j−1)×k+1) to SWEP(j×k) is connected to the data lines DL1 to DL8. j is a natural number no greater than t, which is 160. For example, in the case where j=1, the switching elements are SWEP1 to SWEP8.

The switching elements SWEP1 to SWEP1280 are constituted of TFTs (Thin Film Transistors) or the like, for example, and are controlled based on control signals from the driver 100. For example, the electro-optical panel 200 includes a switching control circuit (not shown), and that switching control circuit controls the switching elements SWEP1 to SWEP1280 to turn on and off based on a control signal such as ENBX.

Figure 16:
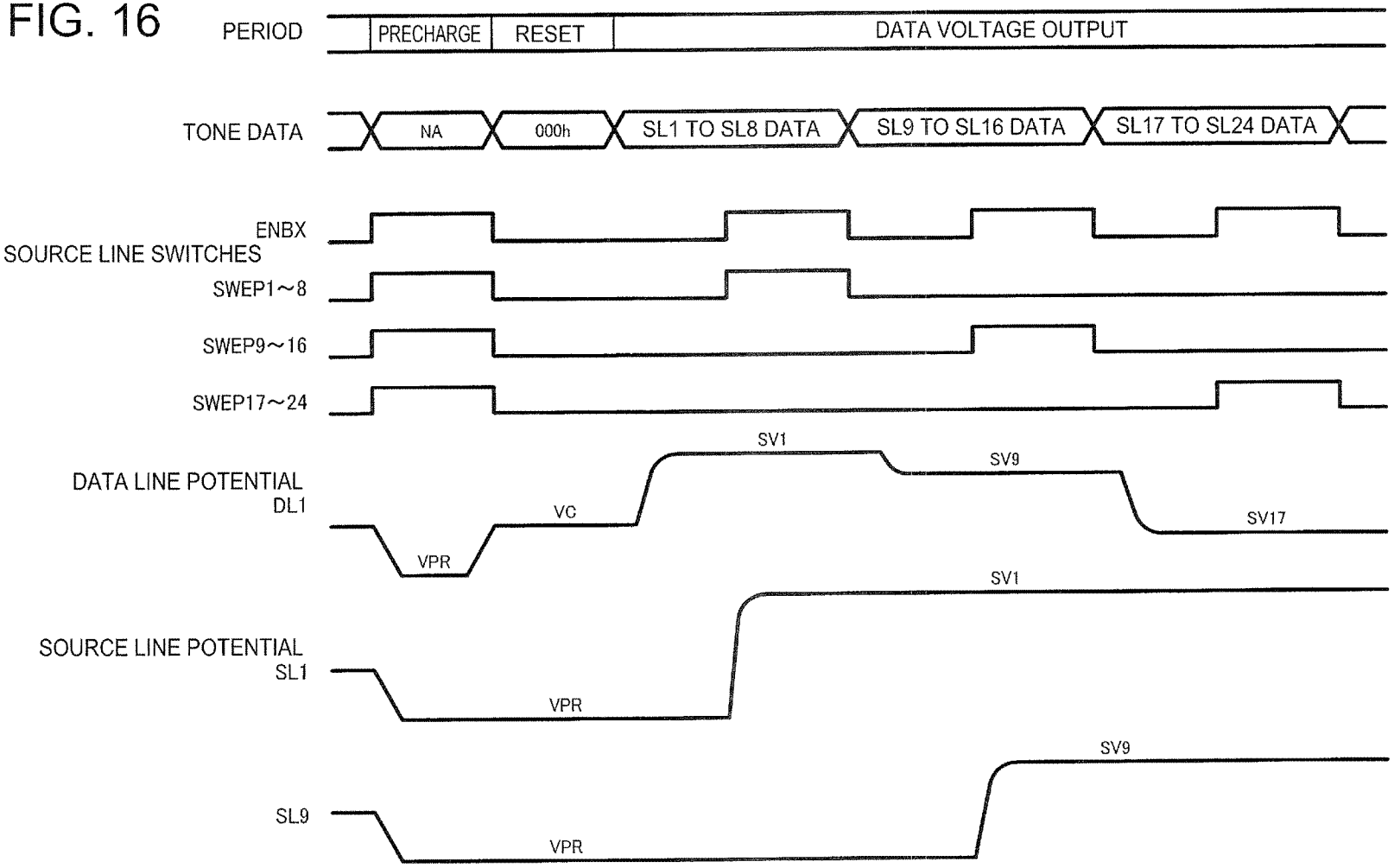
FIG. 16 is an operational timing chart of a driver and an electro-optical panel.

FIG. 16 is an operational timing chart of the driver 100 and the electro-optical panel 200 illustrated in FIG. 15.

In the precharge period, the signal ENBX goes to high-level, and all of the switching elements SWEP1 to SWEP1280 turn on. Then, all of the source lines SL1 to SL1280 are set to the precharge voltage VPR.

In the reset period, the signal ENBX goes to low-level, and the switching elements SWEP1 to SWEP1280 all turn off. The data lines DL1 to DL8 are then set to the reset voltage VC of 7.5 V. The source lines SL1 to SL1280 remain at the precharge voltage VPR.

In a first output period in the data voltage output period, the tone data corresponding to the source lines SL1 to SL8 are inputted into the data line driving circuits DD1 to DD8. Then, capacitive driving is carried out by the capacitor circuit 10 and the capacitor driving circuit 20 and voltage driving is carried out by the voltage driving circuit 80, and the data lines DL1 to DL8 are driven by the data voltages SV1 to SV8. After the capacitive driving and voltage driving start, the signal ENBX goes to high-level, and the switching elements SWEP1 to SWEP8 turn on. Then, the source lines SL1 to SL8 are driven by the data voltages SV1 to SV8. At this time, a single gate line (horizontal scanning line) is selected by a gate driver (not shown), and the data voltages SV1 to SV8 are written into the pixel circuits connected to the selected gate line and the data lines DL1 to DL8. Note that FIG. 16 illustrates potentials of the data line DL1 and the source line SL1 as examples.

In a second output period, the tone data corresponding to the source lines SL9 to SL16 are inputted into the data line driving circuits DD1 to DD8. Then, capacitive driving is carried out by the capacitor circuit 10 and the capacitor driving circuit 20 and voltage driving is carried out by the voltage driving circuit 80, and the data lines DL1 to DL8 are driven by the data voltages SV9 to SV16. After the capacitive driving and voltage driving start, the signal ENBX goes to high-level, and the switching elements SWEP9 to SWEP16 turn on. Then, the source lines SL9 to SL16 are driven by the data voltages SV9 to SV16. At this time, the data voltages SV9 to SV16 are written into the pixel circuits connected to the selected gate line and the data lines DL9 to DL16. Note that FIG. 16 illustrates potentials of the data line DL1 and the source line SL9 as examples.

Thereafter, the source lines SL17 to SL24, SL25 to SL32, . . . , and SL1263 to SL1280 are driven in the same manner in a third output period, a fourth output period, . . . , and a 160th output period, after which the process moves to the postcharge period.

11. Electronic Device

Figure 17:
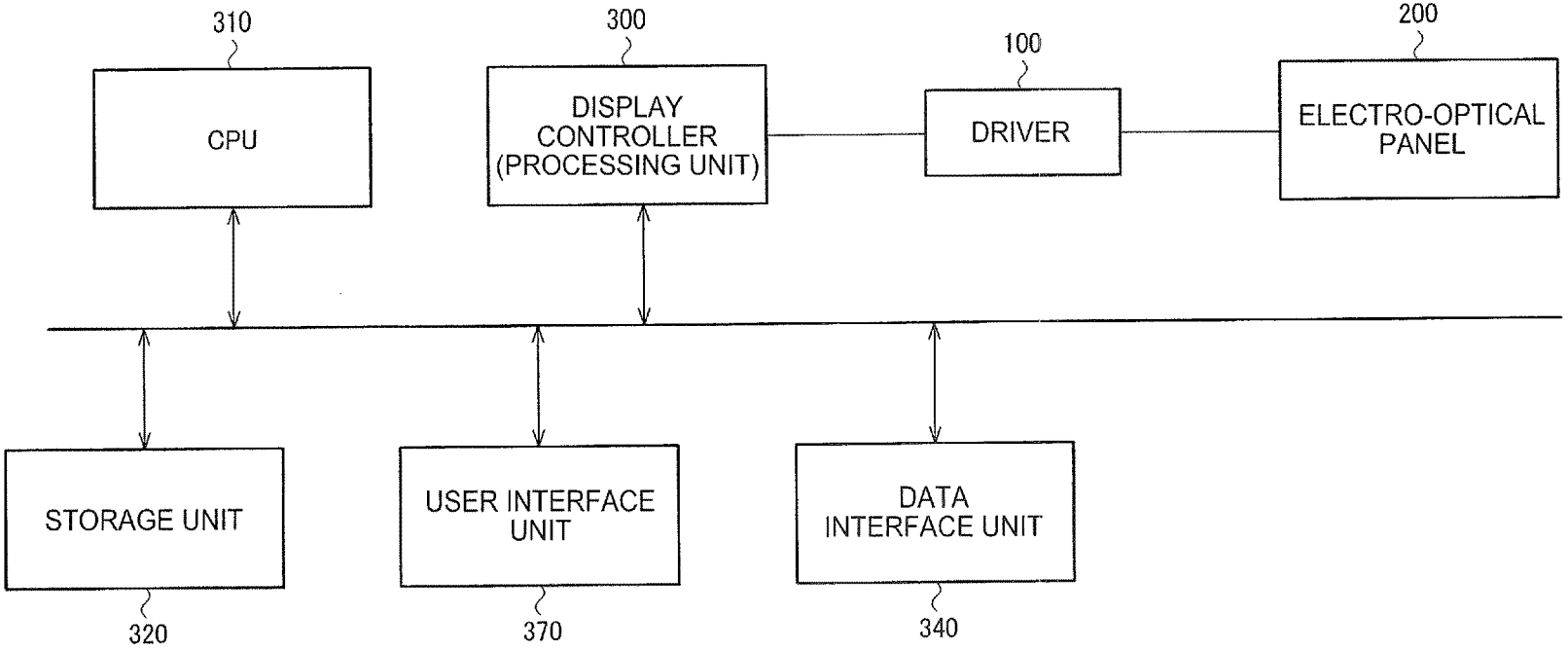
FIG. 17 illustrates an example of the configuration of an electronic device.

FIG. 17 illustrates an example of the configuration of an electronic device in which the driver 100 according to this embodiment can be applied. A variety of electronic devices provided with display devices can be considered as the electronic device according to this embodiment, including projector, a television device, an information processing apparatus (a computer), a mobile information terminal, a car navigation system, a mobile gaming terminal, and so on, for example.

The electronic device illustrated in FIG. 17 includes the driver 100, the electro-optical panel 200, the display controller 300 (a first processing unit), a CPU 310 (a second processing unit), a storage unit 320, a user interface unit 330, and a data interface unit 340.

The electro-optical panel 200 is a matrix-type liquid-crystal display panel, for example. Alternatively, the electro-optical panel 200 may be an EL (Electro-Luminescence) display panel using selfluminous elements. The user interface unit 330 is an interface unit that accepts various operations from a user. The user interface unit 330 is constituted of buttons, a mouse, a keyboard, a touch panel with which the electro-optical panel 200 is equipped, or the like, for example. The data interface unit 340 is an interface unit that inputs and outputs image data, control data, and the like. For example, the data interface unit 340 is a wired communication interface such as USB, a wireless communication interface such as a wireless LAN, or the like. The storage unit 320 stores image data inputted from the data interface unit 340. Alternatively, the storage unit 320 functions as a working memory for the CPU 310, the display controller 300, or the like. The CPU 310 carries out control processing for the various units in the electronic device, various types of data processing, and so on. The display controller 300 carries out control processing for the driver 100. For example, the display controller 300 converts image data transferred from the data interface unit 340, the storage unit 320, or the like into a format that can be handled by the driver 100, and outputs the converted image data to the driver 100. The driver 100 drives the electro-optical panel 200 based on the image data transferred from the display controller 300.

Although the foregoing has described embodiments of the invention in detail, one skilled in the art will easily recognize that many variations can be made thereon without departing from the essential spirit of the novel items and effects of the invention. Such variations should therefore be taken as being included within the scope of the invention. For example, in the specification or drawings, terms denoted at least once along with terms that have broader or the same definitions as those terms ("low-level" and "high-level" for "first logic level" and "second logic level", respectively) can be replaced with those terms in all areas of the specification or drawings. Furthermore, all combinations of the embodiments and variations fall within the scope of the invention. Finally, the configurations and operations of the capacitor circuit, capacitor driving circuit, variable capacitance circuit, detection circuit, control circuit, reference voltage generation circuit, D/A conversion circuit, voltage driving circuit, driver, electro-optical panel, and electronic device are not limited to those described in the embodiments, and many variations can be made thereon.

The entire disclosure of Japanese Patent Application No. 2014-210367, filed Oct. 15, 2014 is expressly incorporated by reference herein.

What is claimed is:

1. A driver comprising:

a capacitor driving circuit that outputs first to nth capacitor driving voltages (where n is a natural number of 2 or more) corresponding to tone data to first to nth capacitor driving nodes;

a capacitor circuit including first to nth capacitors provided between the first to nth capacitor driving nodes and a data voltage output terminal; and a voltage driving circuit that carries out voltage driving, which outputs a data voltage corresponding to the tone data to the data voltage output terminal, after capacitive driving, which drives an electro-optical panel using the capacitor driving circuit and the capacitor circuit, has been started, wherein the voltage driving circuit includes: an amplifier circuit that outputs the data voltage; and a switching circuit provided between an output of the amplifier circuit and the data voltage output terminal, and wherein the switching circuit turns off in a first period spanning from the start of the capacitive driving to the start of the voltage driving and turns on in a second period in which the voltage driving is carried out.

2. The driver according to claim 1, further comprising:

a precharge amplifier circuit that outputs a prescribed precharge voltage to the source line of the electro-optical panel in a precharge period that comes before the capacitive driving is carried out.

3. An electronic device comprising the driver according to claim 2.

4. An electronic device comprising the driver according to claim 1.

5. A driver comprising:

a capacitor driving circuit that outputs first to nth capacitor driving voltages (where n is a natural number of 2 or more) corresponding to tone data to first to nth capacitor driving nodes;

a capacitor circuit including first to nth capacitors provided between the first to nth capacitor driving nodes and a data voltage output terminal; and a voltage driving circuit that carries out voltage driving, which outputs a data voltage corresponding to the tone data to the data voltage output terminal, after capacitive driving, which drives an electro-optical panel using the capacitor driving circuit and the capacitor circuit, has been started, wherein the voltage driving circuit includes: an amplifier circuit that outputs the data voltage; and a switching circuit provided between an output of the amplifier circuit and the data voltage output terminal;

a reference voltage generation circuit that generates a plurality of reference voltages; and a D/A conversion circuit that selects a reference voltage corresponding to the tone data from the plurality of reference voltages and outputs the selected reference voltage to the amplifier circuit, wherein the amplifier circuit amplifies the selected reference voltage and outputs the amplified reference voltage as the data voltage after the capacitive driving has been started.

6. An electronic device comprising the driver according to claim 5.

7. A driver comprising:

a capacitor driving circuit that outputs first to nth capacitor driving voltages (where n is a natural number of 2 or more) corresponding to tone data to first to nth capacitor driving nodes;

a capacitor circuit including first to nth capacitors provided between the first to nth capacitor driving nodes and a data voltage output terminal; and a voltage driving circuit that carries out voltage driving, which outputs a data voltage corresponding to the tone data to the data voltage output terminal, after capacitive driving, which drives an electro-optical panel using the capacitor driving circuit and the capacitor circuit, has been started, wherein the voltage driving circuit includes: an amplifier circuit that outputs the data voltage; and a switching circuit provided between an output of the amplifier circuit and the data voltage output terminal, wherein the electro-optical panel includes a switching element provided between a data line and a source line, and wherein the switching circuit of the voltage driving circuit turns on after the capacitive driving has started and before the switching element of the electro-optical panel turns on.

8. The driver according to claim 7, wherein the switching circuit of the voltage driving circuit turns off after the switching element of the electro-optical panel turns from on to off.

9. An electronic device comprising the driver according to claim 8.

10. An electronic device comprising the driver according to claim 7.

11. A driver comprising:

a capacitor driving circuit that outputs first to nth capacitor driving voltages (where n is a natural number of 2 or more) corresponding to tone data to first to nth capacitor driving nodes;

a capacitor circuit including first to nth capacitors provided between the first to nth capacitor driving nodes and a data voltage output terminal; and a voltage driving circuit that carries out voltage driving, which outputs a data voltage corresponding to the tone data to the data voltage output terminal, after capacitive driving, which drives an electro-optical panel using the capacitor driving circuit and the capacitor circuit, has been started, wherein the voltage driving circuit includes a switching circuit provided between an output of the voltage driving circuit and the data voltage output terminal, and wherein the switching circuit turns off in a first period spanning from the start of the capacitive driving to the start of the voltage driving and turns on in a second period in which the voltage driving is carried out.

* * * * *